US012078456B1

(12) United States Patent
Finch et al.

(10) Patent No.: US 12,078,456 B1
(45) Date of Patent: Sep. 3, 2024

(54) ANTI-BALLISTIC BARRIER WITH EXTENDABLE RETENTION SYSTEM

(71) Applicant: Ballistic Barrier Products, Inc., Johnson City, TN (US)

(72) Inventors: Andrew Finch, Mesa, AZ (US); Ronald G. Egres, Jr., Jonesborough, TN (US)

(73) Assignee: BALLISTIC BARRIER PRODUCTS, INC., Johnson City, TN (US)

( * ) Notice: Subject to any disclaimer, the term of this patent is extended or adjusted under 35 U.S.C. 154(b) by 171 days.

(21) Appl. No.: 17/943,040

(22) Filed: Sep. 12, 2022

Related U.S. Application Data

(63) Continuation-in-part of application No. 17/672,075, filed on Feb. 15, 2022, now Pat. No. 11,585,640.

(51) Int. Cl.
*F41H 5/06* (2006.01)
*F41H 5/013* (2006.01)

(52) U.S. Cl.
CPC ..... *F41H 5/06* (2013.01); *F41H 5/013* (2013.01)

(58) Field of Classification Search
CPC ..... F41H 5/06; F41H 5/013
USPC ..... 89/36.02
See application file for complete search history.

(56) References Cited

U.S. PATENT DOCUMENTS 983,663 A 2/1911 White
2,149,481 A 3/1939 Van Bosch et al.
2,366,514 A 1/1945 Gaylor
3,832,265 A 8/1974 Denommee
5,188,161 A 2/1993 Erber
5,196,252 A 3/1993 Harpell
(Continued)

FOREIGN PATENT DOCUMENTS

AU 2009201524 A1 11/2009
DE 3407580 A1 9/1985
DE 202014104511 U1 * 11/2014 ..... F41H 5/013

OTHER PUBLICATIONS

European Committee for Standardization, "Shutters, External Blinds, Internal Blinds—Terminology, Glossary and Definitions," European Standard EN 12216, Aug. 2002, Edition: Dec. 1, 2002, Österreichisches Normungsinstitut, 1020 Vienna.
(Continued)

*Primary Examiner* — Samir Abdosh
(74) *Attorney, Agent, or Firm* — Booth Udall Fuller, PLC; Kenneth C. Booth

(57) ABSTRACT

An anti-ballistic barrier system with a plurality of support mounts and an anti-ballistic shield configured to extend across a targeted area. The plurality of support mounts is configured to couple the shield to a support structure adjacent the targeted area. A plurality of extendable connectors extends between the anti-ballistic shield and the plurality of support mounts. A polyester shield cover may extend over the anti-ballistic shield. The plurality of extendable connectors may be positioned at regular intervals around a perimeter of the shield and may be formed of a material having an elongation percentage property of at least 100%. The anti-ballistic shield may be movable between a retracted position in which a majority of the targeted area is exposed and an extended position in which the anti-ballistic shield extends across a majority of the targeted area.

20 Claims, 35 Drawing Sheets

(56) References Cited

U.S. PATENT DOCUMENTS

| | | | | |
|---|---|---|---|---|
| 5,939,658 | A * | 8/1999 | Muller | F41H 5/08 89/36.02 |
| 6,296,041 | B1 * | 10/2001 | Cicero | E06B 9/02 160/368.1 |
| 6,298,766 | B1 | 10/2001 | Mor | |
| 7,694,482 | B2 | 4/2010 | Gazaway et al. | |
| 7,726,081 | B1 | 6/2010 | Bennardo et al. | |
| 9,134,097 | B1 | 9/2015 | De Gaglia | |
| 10,151,566 | B2 | 12/2018 | Adrain | |
| 10,473,437 | B2 | 11/2019 | Adrain | |
| 10,801,815 | B2 | 10/2020 | Adrain | |
| 11,220,859 | B2 | 1/2022 | Hendrix | |
| 11,313,651 | B2 * | 4/2022 | Hadtke | F41H 5/08 |
| 2005/0230061 | A1 | 10/2005 | Wilkins | |
| 2007/0180982 | A1 * | 8/2007 | Dagher | F41H 5/013 89/36.02 |
| 2009/0308543 | A1 * | 12/2009 | Kates | E06B 9/72 160/310 |
| 2010/0043292 | A1 * | 2/2010 | Wilkins | F41H 7/035 89/36.01 |
| 2010/0164743 | A1 | 7/2010 | Domel et al. | |
| 2010/0297388 | A1 * | 11/2010 | Dagher | F42D 5/045 977/773 |
| 2012/0011993 | A1 * | 1/2012 | Malone | F41H 7/02 89/36.02 |
| 2012/0036988 | A1 * | 2/2012 | Daniels | F41H 5/06 89/36.02 |
| 2012/0180633 | A1 * | 7/2012 | Dagher | F41H 5/013 89/914 |
| 2014/0295131 | A1 * | 10/2014 | Pilpel | B32B 5/02 428/113 |
| 2016/0209181 | A1 * | 7/2016 | Adrain | F41H 5/013 |
| 2019/0113312 | A1 * | 4/2019 | Adrain | F41H 5/26 |
| 2020/0393217 | A1 * | 12/2020 | Adrain | E06B 9/40 |
| 2021/0254934 | A1 | 8/2021 | Hadtke | |
| 2021/0285743 | A1 * | 9/2021 | Adrain | B32B 27/065 |
| 2022/0390211 | A1 * | 12/2022 | Adrain | E06B 9/382 |
| 2023/0304774 | A1 * | 9/2023 | Adrain | B32B 27/12 |

OTHER PUBLICATIONS

European Committee for Standardization, "Windows, Doors, Shutters and Blinds, Bullet Resistance—Requirements and Classification," European Standard EN 1522, Oct. 1998, DIN Deutsches Institut für Normung e.V., Berlin, DE.

European Committee for Standardization, "Windows, Doors, Shutters and Blinds, Bullet Resistance—Test Method," European Standard EN 1523, Oct. 1998, DIN Deutsches Institut für Normung e.V., Berlin, DE.

Notice of Allowance dated Oct. 21, 2022 for U.S. Appl. No. 17/672,075 (pp. 1-5).

* cited by examiner

ANTI-BALLISTIC BARRIER WITH EXTENDABLE RETENTION SYSTEM

CROSS REFERENCE TO RELATED APPLICATIONS

This application is a continuation-in-part of U.S. Application Ser. No. 17/672,075, filed on Feb. 15, 2022, entitled "ANTI-BALLISTIC BARRIER WITH EXTENDABLE RETENTION SYSTEM," the entirety of the disclosure of which is hereby incorporated herein by this reference.

TECHNICAL FIELD

Aspects of this document relate generally to anti-ballistic barriers and more particularly to deployable and fixed anti-ballistic barriers with an extendable retention system.

BACKGROUND

Anti-ballistic barriers are widely known throughout the world in security and law enforcement industries. Such anti-ballistic barriers have been formed into clothing items, automobile and other mobile equipment paneling, building reinforcement, and backpacks, bags and holders for weapons. Although anti-ballistic barriers come in many shapes, sizes, thicknesses and levels of hardness, among the flexible anti-ballistic fabrics, poly-para-phenelyne terephthalamide, commonly sold under the brand name Kevlar®, is one of the most widely known and recognized brand of anti-ballistic barrier fabrics. Kevlar® is heat-resistant para-aramid synthetic fiber with a molecular structure that includes many repeating inter-chain bonds that cross-link with hydrogen bonds, providing a tensile strength greater than steel on an equal weight basis. Multiple ply assemblies of textile structures generated from Kevlar® or other high strength fibers result in the anti-ballistic barrier material being able to "catch" a projectile while absorbing and dissipating its energy.

Multiple layers of anti-ballistic barrier materials are often laminated, mixed or otherwise combined together to form a composite material with properties of multiple anti-ballistic material layers. U.S. Pat. No. 5,196,252 to Harpel titled Ballistic Resistant Fabric Articles, granted Mar. 23, 1993, and U.S. Pat. No. 3,832,265 to Denommee titled Ballistic Armor of Piles of Nylon Fabric and Piles of Glass Fabric, granted Aug. 27, 1974 include non-limiting examples of the variety of combinations considered.

One application for anti-ballistic barriers is in the window blind and shutter industry. U.S. Pat. No. 983,663 to White titled Device for Protection of Display Windows, granted Feb. 7, 1911, US Patent Publication 2005/0230061 to Wilkins titled Combined Window Blind and Security Shutter, published Oct. 20, 2005, U.S. Pat. No. 6,296,041 to Cicero titled Window Net Child Safety Guard, granted Oct. 2, 2001, U.S. Pat. No. 7,726,081 to Bennardo et al. titled Hurricane Net Wind Abatement System, granted Jun. 1, 2010, and U.S. Pat. No. 10,151,566 to Adrain titled Bullet Proof Blinds, granted Dec. 11, 2018 each illustrate various applications for anti-ballistic barriers applied to windows. U.S. Pat. No. 5,939,658 to Muller titled Portable Tactical Shield System, granted Aug. 17, 1999 provides an example of a mobile anti-ballistic barrier system for application to a doorway or window.

SUMMARY

Aspects of this document relate to an anti-ballistic barrier system comprising an anti-ballistic shield formed of a flexible poly-aramid anti-ballistic material and configured to extend across a targeted area, a polyester shield cover extending over a majority of each of a front side and a back side of the anti-ballistic shield, the polyester shield cover coupled to the anti-ballistic shield, a plurality of support mounts configured to fixedly couple with a support structure adjacent to the targeted area, wherein the plurality of support mounts is configured to be positioned at regular intervals around a perimeter of the targeted area, and a plurality of extendable connectors fixedly attached to the anti-ballistic shield, wherein the plurality of extendable connectors are positioned at regular intervals around a perimeter of the anti-ballistic shield, the plurality of extendable connectors is configured to extend between the anti-ballistic shield and the plurality of support mounts and couple the anti-ballistic shield to the plurality of support mounts, and each of the plurality of extendable connectors is formed of a material having an elongation percentage property of at least 100%.

Particular embodiments may comprise one or more of the following features. The anti-ballistic shield may be movable between an extended position in which the anti-ballistic shield extends across a majority of the targeted area and a retracted position in which a majority of the targeted area is exposed. The plurality of support mounts may comprise a bar secured to the support structure and at least one of the plurality of extendable connectors may be configured to loop around the bar.

Aspects of this document relate to an anti-ballistic barrier system comprising an anti-ballistic shield formed of a flexible poly-aramid anti-ballistic material and configured to extend across a targeted area, at least one support mount configured to fixedly couple with a support structure adjacent to the targeted area, and at least two extendable connectors fixedly attached to the anti-ballistic shield, wherein the at least two extendable connectors are positioned along at least one side of the anti-ballistic shield, each of the at least two extendable connectors is configured to extend between the anti-ballistic shield and one of the at least one support mount and couple the anti-ballistic shield to the at least one support mount, and each of the at least two extendable connectors is formed of a material having an elongation percentage property of at least 50%.

Particular embodiments may comprise one or more of the following features. The anti-ballistic barrier system may further comprise a shield cover extending over a majority of each of a front side and a back side of the anti-ballistic shield, the shield cover coupled to the anti-ballistic shield. The at least one support mount may be a plurality of support mounts. The plurality of support mounts may be configured to be positioned at regular intervals along at least two sides of the targeted area. Each of the at least two extendable connectors may be formed of a material having an elongation percentage property of at least 100%. The anti-ballistic shield may be movable between an extended position in which the anti-ballistic shield extends across a majority of the targeted area and a retracted position in which a majority of the targeted area is exposed. The at least one support mount may comprise a bar secured to the support structure and at least one of the at least two extendable connectors may be configured to loop around the bar.

Aspects of this document relate to an anti-ballistic barrier system comprising an anti-ballistic shield formed of a flexible poly-aramid anti-ballistic material and configured to extend across a targeted area, at least one support mount configured to fixedly couple with a support structure adjacent to the targeted area, and at least one extendable connector attached to the anti-ballistic shield, wherein the at least one extendable connector is configured to extend between the anti-ballistic shield and the at least one support mount and couple the anti-ballistic shield to the at least one support mount, and wherein each of the at least one extendable connector is formed of a material having an elongation percentage property of at least 50%.

Particular embodiments may comprise one or more of the following features. The at least one extendable connector may be fixedly attached to the anti-ballistic shield. The at least one extendable connector may be a plurality of extendable connectors. The plurality of extendable connectors may be positioned at regular intervals along at least two sides of the anti-ballistic shield. The anti-ballistic barrier system may further comprise a shield cover extending over a majority of each of a front side and a back side of the anti-ballistic shield, the shield cover coupled to the anti-ballistic shield. The at least one support mount may be a plurality of support mounts. The plurality of support mounts may be configured to be positioned at regular intervals along at least two sides of the targeted area. Each of the plurality of extendable connectors may be formed of a material having an elongation percentage property of at least 100%. The anti-ballistic shield may be movable between an extended position in which the anti-ballistic shield extends across a majority of the targeted area and a retracted position in which a majority of the targeted area is exposed. The at least one support mount may comprise a bar secured to the support structure and the at least one extendable connector may be configured to loop around the bar.

Aspects of this document relate to an anti-ballistic barrier system comprising a top shield support and a bottom shield support, an anti-ballistic shield formed of a flexible polyaramid anti-ballistic material, a first extendable connector extending between and attached to the anti-ballistic shield and the top shield support, and a second extendable connector extending between and attached to the anti-ballistic shield and the bottom shield support, the first and second extendable connectors each formed of a material having an elongation percentage property of at least 100%, a polyester shield cover extending over a majority of each of front and back sides of the anti-ballistic shield, the polyester shield cover coupled to the anti-ballistic shield, and at least two top mounting brackets configured to rotatably attach the top shield support to a vertical structure and at least one bottom mounting bracket configured to releasably attach the bottom shield support to the vertical structure, wherein the anti-ballistic shield is movable between a retracted position in which a majority of the anti-ballistic shield is wrapped around the top shield support and the bottom shield support is detached from the at least one bottom mounting bracket, and an extended position in which a majority of the anti-ballistic shield is unwrapped from the top shield support and the bottom shield support is engaged with the at least one bottom mounting bracket to retain the anti-ballistic shield in the extended position.

Particular embodiments may comprise one or more of the following features. The first extendable connector and the second extendable connector may each be formed of a stretch fabric material having an elongation percentage property of at least 250%. The anti-ballistic material may comprise a multi-layered laminate material. The anti-ballistic barrier system may further comprise a release button operably associated with the at least one bottom mounting bracket and configured to release the bottom shield support from the at least one bottom mounting bracket when activated. The anti-ballistic barrier system may further comprise an anti-ballistic shield release configured to automatically release the anti-ballistic shield from the retracted position in response to at least one environmental change. The at least one environmental change may include at least one of a noise, a glass break sound and a pre-determined frequency. The anti-ballistic barrier system may further comprise an anti-ballistic shield release configured as a quick release lever operably associated with the top shield support and configured to retain the anti-ballistic shield in the retracted position until the quick release lever is activated and then release the anti-ballistic shield from the retracted position so that the anti-ballistic shield is moveable to the extended position. The anti-ballistic barrier system may further comprise at least one of a pull-chord and a motor operably associated with the top shield support and configured to raise the anti-ballistic shield from the extended position to the retracted position upon activation.

Aspects of this document relate to an anti-ballistic barrier system comprising a top shield support and a bottom shield support, each configured to attach to a support structure, an anti-ballistic shield formed of a flexible anti-ballistic material, and a first extendable connector extending between and attached to the anti-ballistic shield and the top shield support, and a second extendable connector extending between and attached to the anti-ballistic shield and the bottom shield support, the first and second extendable connectors each formed of a material having an elongation percentage property of at least 100%, wherein the anti-ballistic shield is movable between a retracted position in which a majority of the anti-ballistic shield is wrapped around the top shield support and the bottom shield support is detached from the at least one bottom mounting bracket, and an extended position in which a majority of the anti-ballistic shield is unwrapped from the top shield support and the bottom shield support is engaged with the at least one bottom mounting bracket to retain the anti-ballistic shield in the extended position.

Particular embodiments may comprise one or more of the following features. The anti-ballistic barrier system may further comprise a shield cover extending over a majority of each of front and back sides of the anti-ballistic shield. The anti-ballistic barrier system may further comprise a top mounting bracket configured to rotatably attach the top shield support to a vertical structure and at least one bottom mounting bracket configured to releasably attach the bottom shield support to the vertical structure. The first extendable connector and the second extendable connector may each be formed of a stretch fabric material having an elongation percentage property of at least 250%. The anti-ballistic barrier system may further comprise an anti-ballistic shield release configured to release the anti-ballistic shield from the retracted position, wherein the anti-ballistic shield is configured to automatically extend to the extended position. The anti-ballistic barrier system may further comprise an anti-ballistic shield release configured as a quick release lever operably associated with the top shield support and configured to retain the anti-ballistic shield in the retracted position until the quick release lever is activated and then release the anti-ballistic shield from the retracted position so that the anti-ballistic shield is moveable to the extended position. The anti-ballistic barrier system may further comprise at least one of a pull-chord and a motor operably associated with the top shield support and configured to raise the anti-ballistic shield from the extended position to the retracted position upon activation.

Aspects of this document relate to an anti-ballistic barrier system comprising a top shield support and a bottom shield support, an anti-ballistic shield formed of a flexible anti-ballistic material extending between the top shield support and the bottom shield support, and an extendable connector coupled to at least one of the top shield support and the bottom shield support and configured to absorb energy when the anti-ballistic shield is hit with a ballistic force, wherein the anti-ballistic shield is movable between a retracted position and an extended position.

Particular embodiments may comprise one or more of the following features. The anti-ballistic barrier system may further comprise a shield cover extending over a majority of each of front and back sides of the anti-ballistic shield. The anti-ballistic barrier system may further comprise a top mounting bracket configured to rotatably attach the top shield support to a vertical structure and at least one bottom mounting bracket configured to releasably attach the bottom shield support to the vertical structure. In the retracted position, the anti-ballistic shield may be wrapped around the top shield support and in the extended position the anti-ballistic shield may be unwrapped from the top shield support and the bottom shield support may be engaged to retain the anti-ballistic shield in the extended position. The anti-ballistic barrier system may further comprise an anti-ballistic shield release configured to release the anti-ballistic shield from the retracted position, wherein the anti-ballistic shield is configured to automatically extend to the extended position.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
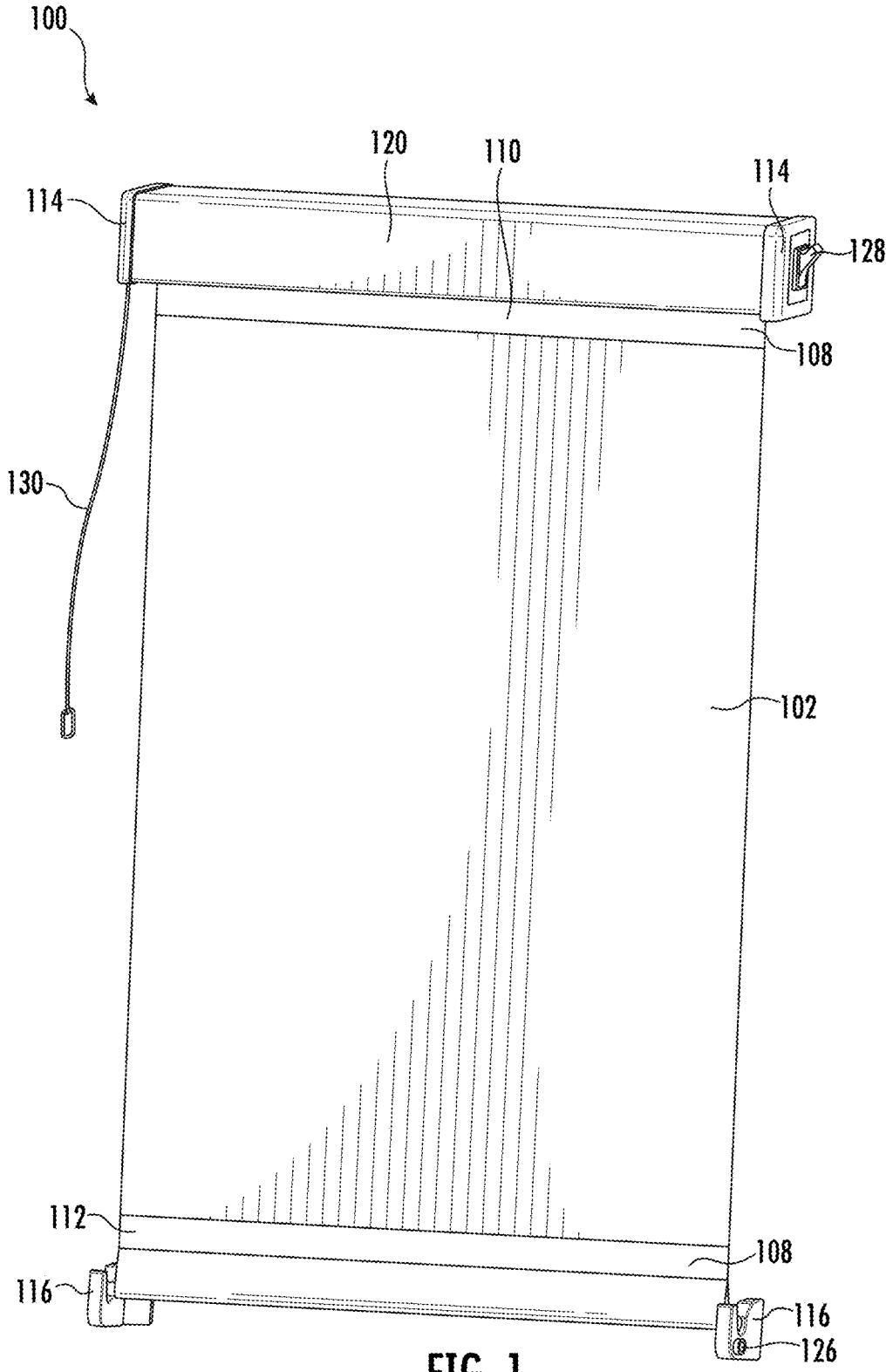
FIG. 1 is a perspective view of an anti-ballistic barrier system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to an anti-ballistic barrier system 100 that is configured to increase the level of protection available to individuals in locations equipped with the anti-ballistic barrier system 100. The anti-ballistic barrier system 100 is designed to cover targeted areas that may be vulnerable to a ballistic attack. For example, an anti-ballistic barrier system 100 may be installed to cover a door 20 or window 10 (see FIGS. 10A-10B and 12A-12B) because attackers often focus their attacks through these locations. By providing a deployable anti-ballistic barrier system 100 at these targeted areas, projectiles may be blocked from passing the anti-ballistic barrier system 100, even if the window 10 or door 20 fails to stop the projectile. The anti-ballistic barrier system 100 may also be useful when installed over a vertical surface of a desk 30 or a wall 40 (see FIGS. 13A-14B). For example, an anti-ballistic barrier system 100 may be installed on the desk 30 of a courtroom, bank, or office. If a ballistic attack occurs, those nearest the attacker, including the judge, teller, or executive who may be the target of the attack, could seek shelter behind the desk 30. With an anti-ballistic barrier system 100 installed, the desk 30 provides improved protection over a desk 30 without an anti-ballistic barrier system installed. The anti-ballistic barrier system 100 may also be used as a barricade over targeted areas that do not involve vertical surfaces. For example, the anti-ballistic barrier system 100 may be configured to cover a hallway or other pathway through which individuals typically pass. In addition, the anti-ballistic barrier system 100 may be a free-standing barricade covering a targeted area between two posts 50 (see FIG. 15A).

As shown in FIGS. 1-9, an anti-ballistic barrier system 100 may comprise an anti-ballistic shield 102, a top shield support 104, a bottom shield support 106, and an extendable connector 108. In some embodiments, the extendable connector 108 comprises a first extendable connector 110 and a second extendable connector 112. An anti-ballistic barrier system 100 may also comprise a top mounting bracket 114, a bottom mounting bracket 116, and/or a shield cover 118.

The anti-ballistic shield 102 is configured to catch projectiles and prevent them from passing through. Thus, the anti-ballistic shield 102 may be formed of an anti-ballistic material configured to resist penetration due to ballistic forces. For example, a flexible anti-ballistic material generated from para-aramid or ultra high molecular weight polyethylene (UHMWPE) fiber may be used. The anti-ballistic material used may be a woven fabric, a knit fabric, a nonwoven felt, a cross-plied unidirectional fiber laminate, a multiaxial fabric, a woven multilayer fabric, a stitch or felt consolidated multiple woven fabric, or other type of material. Other anti-ballistic materials may also be used. In some embodiments, the anti-ballistic material comprises a multi-layered laminate material. More recent examples of anti-ballistic barrier fabrics include many more particular combinations of materials forming anti-ballistic materials, any of which are applicable to the anti-ballistic barriers disclosed and described herein.

Because the anti-ballistic shield 102 is flexible, a top shield support 104 and a bottom shield support 106 are provided. The top shield support 104 extends along the top of the targeted area, while the bottom shield support 106 extends along the bottom of the targeted area. Each of the top shield support 104 and the bottom shield support 106 may be configured as an elongated rod with any cross-sectional shape. The top shield support 104 and the bottom shield support 106 may be configured to attach to a support structure, such as the top mounting bracket 114 and the bottom mounting bracket 116 as disclosed in more detail below.

The anti-ballistic shield 102 may be coupled directly to the top shield support 104 and/or the bottom shield support 106, and thus be supported to cover the targeted area. However, in embodiments where the anti-ballistic shield 102 is directly coupled to the top shield support 104 and the bottom shield support 106, the anti-ballistic barrier system 100 may not be capable of sustaining as much projectile force. By overly restraining the anti-ballistic shield 102, projectiles may more easily pass through the anti-ballistic barrier system 100, compromise the attachment of the anti-ballistic shield to the supports, or compromise the attachment of mounting brackets to the support structure.

An extendable connector 108 may be included to extend between the anti-ballistic shield 102 and either the top shield support 104 or the bottom shield support 106. For example, as shown in FIG. 1, the first extendable connector 110 extends between and is attached to the anti-ballistic shield 102 and the top shield support 104 and the second extendable connector 112 extends between and is attached to the anti-ballistic shield 102 and the bottom shield support 106. The extendable connectors 108 may be formed of a material configured to stretch when subject to tensile forces. The material may be configured to extend due to stretching in the individual fibers of the material, or due to the way the material is formed. For example, knitted materials naturally stretch to a certain degree, regardless of the fibers used. The extendable connectors 108 may each have an elongation percentage property of at least 200%. In some embodiments, the elongation percentage may be at least 50%, at least 100%, at least 150%, or at least 250%. In a particular embodiment, the elongation percentage property is between 250% and 325%. The extendable connectors 108 may be formed of a stretch fabric such as spandex, elastane, or other elastic material. Elongation percentage is a measure of deformation that occurs before a material eventually breaks when subjected to a tensile load by measuring the length at breaking point expressed as a percentage of its original length at rest. In other embodiments, a metal or plastic spring may be used, or other connector with an appropriate elongation percentage.

A high elongation percentage allows the extendable connectors 108 to maintain a connection between the top shield support 104 or the bottom shield support 106 while the anti-ballistic shield 102 moves in response to projectile impacts. Essentially, the extendable connectors 108 absorb a portion of the energy of the projectile, helping to slow the projectile down so that the anti-ballistic shield 102 can fully stop the projectile.

Because the extendable connectors 108 stretch to a maximum length based on an original length, the length of extendable connector 108 determines how far the extendable connector 108 can stretch. For example, if the extendable connector 108 is ½ inch long and has an elongation percentage property of 200%, then the maximum length of the extendable connector 108 is 1.5 inches. As another example, if the extendable connector 108 is 2 inches long and has an elongation percentage property of 200%, then the maximum length of the extendable connector 108 is 6 inches. Thus, depending on how far the user is willing to allow the anti-ballistic barrier system 100 to move from the plane of the targeted area, the extendable connector 108 may be implemented with a longer or a shorter length. In particular implementations, the extendable connector 108 has a length of between 1 inch and 2 inches.

Figure 3:
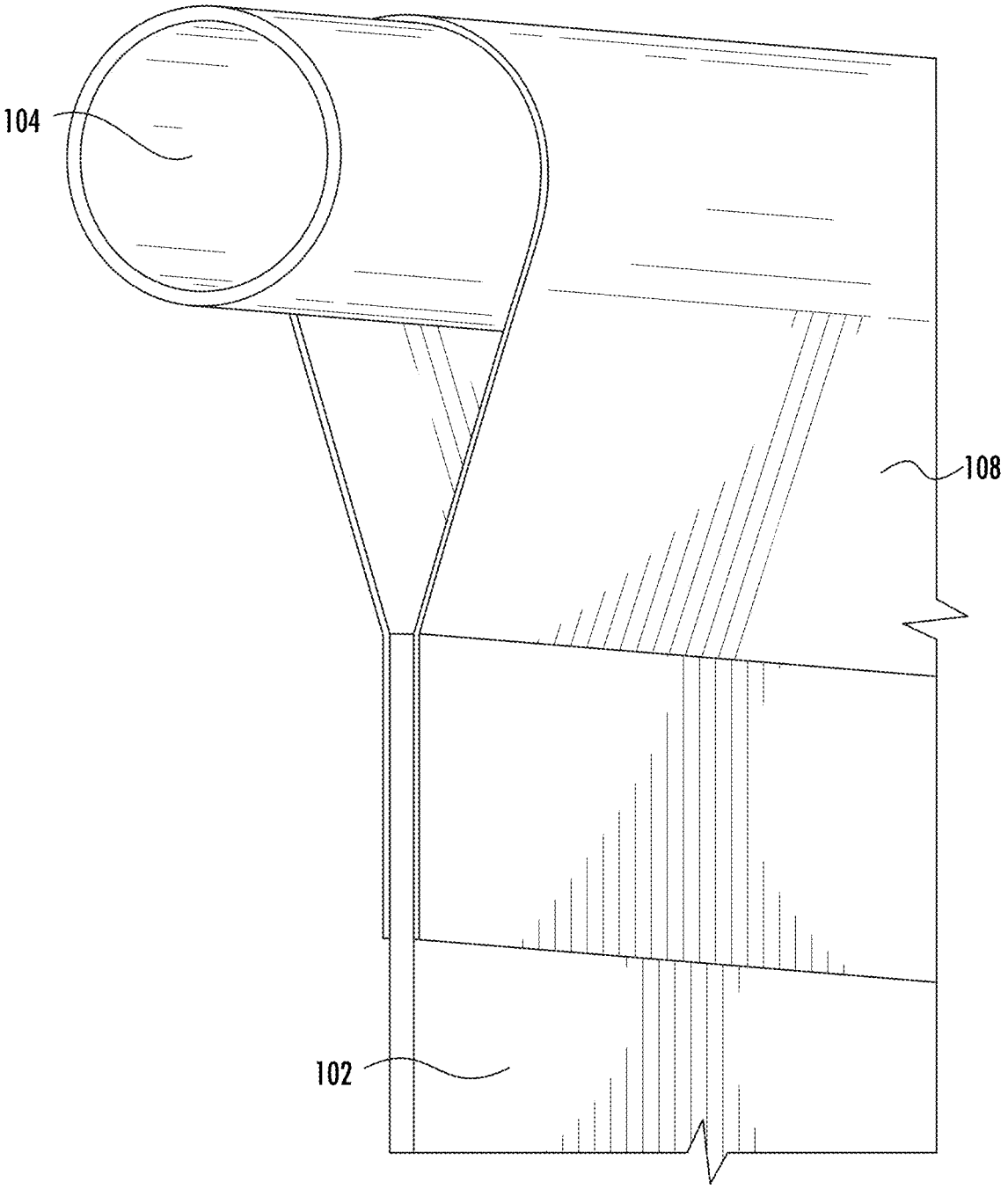
FIG. 3 is a close-up view of the first extendable connector of the anti-ballistic barrier system shown in FIG. 1 attached to the anti-ballistic shield and to the top shield support.

As shown in FIG. 3, in some embodiments, the extendable connectors 108 loop around the top shield support 104 or the bottom shield support 106. The extendable connectors 108 may loop around the top shield support 104 along the length of the top shield support 104 or around the bottom shield support 106 along the length of the bottom shield support 106. This provides support along the entire bottom edge or top edge of the anti-ballistic shield 102 and helps prevent the anti-ballistic shield 102 and the extendable connectors 108 from bunching up or folding in on itself.

Figure 17:
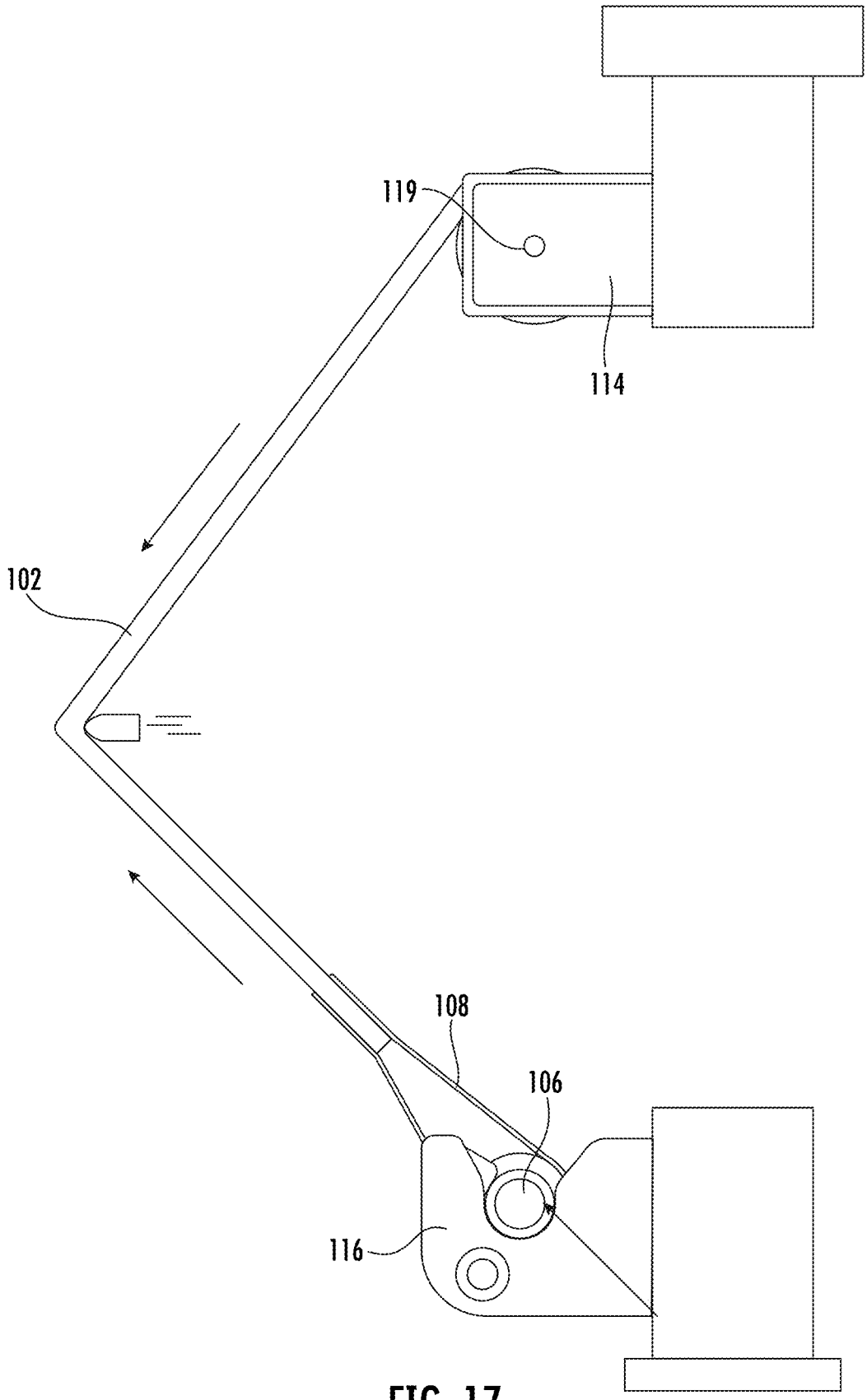
FIG. 17 is a side view of another embodiment of an anti-ballistic barrier system in the extended position being impacted by a projectile, where the top extendable connector is a torsion spring.

In some embodiments, the anti-ballistic shield 102 may be directly attached to the top shield support 104 and/or the bottom shield support 106. In such an embodiment, the anti-ballistic shield 102 may be longer than the distance between the top mounting bracket 114 and the bottom mounting bracket 116. Thus, when the bottom shield support 106 is coupled with the bottom mounting bracket 116, an excess portion of the anti-ballistic shield 102 is still wrapped around the top shield support 104 (see FIG. 17). The top shield support 104 may be coupled to the top mounting bracket 114 with a torsion spring 119 that serves as the extendable connector 108. The torsion spring 119 is configured to bias the top shield support 104 to rotate and wrap more of the anti-ballistic shield 102 around the top shield support 104. Thus, when the anti-ballistic shield 102 is in the extended position, the anti-ballistic shield 102 is taut, but when a projectile impacts the anti-ballistic shield 102, the excess portion of the anti-ballistic shield 102 that is still wrapped around the top shield support 104 can unroll, taking energy from the projectile and storing it in the torsion spring 119. This provides the needed elasticity to stop the projectile. Similar to the extendable connectors 108, the torsion spring 119 thus allows the anti-A ballistic shield 102 to move to catch the projectile. Once the projectile has been stopped, the torsion spring 119 rotates the top shield support 104 to wrap the excess portion of the anti-ballistic shield 102 back around the top shield support 104.

Figure 4A:
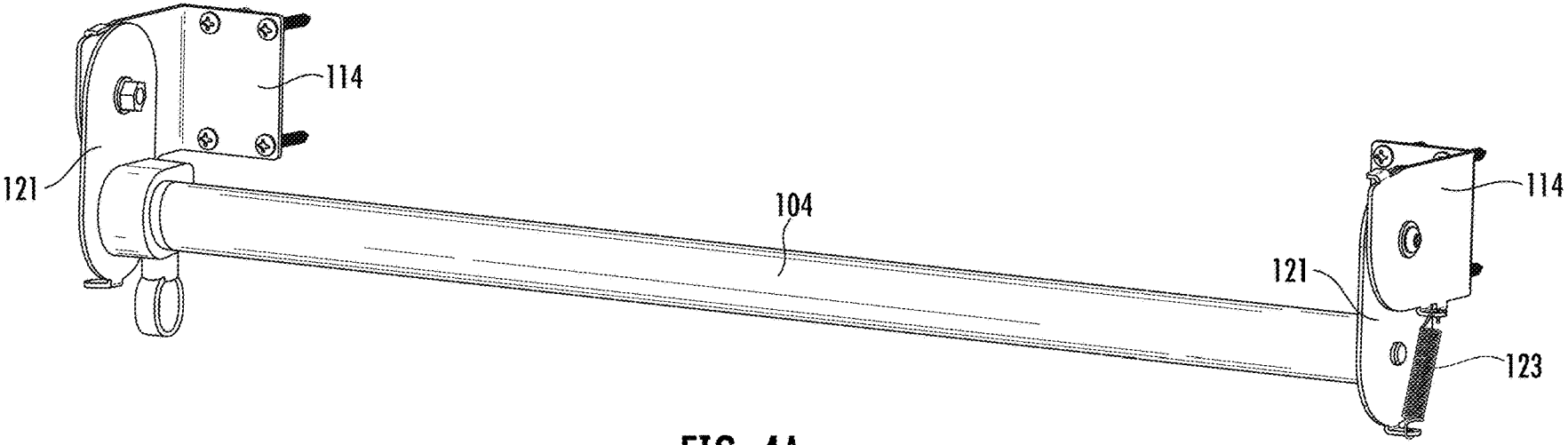
FIG. 4A is a perspective view of an embodiment of the top shield support and top mounting bracket, where the extendable connector is a compression spring.
Figure 4B:
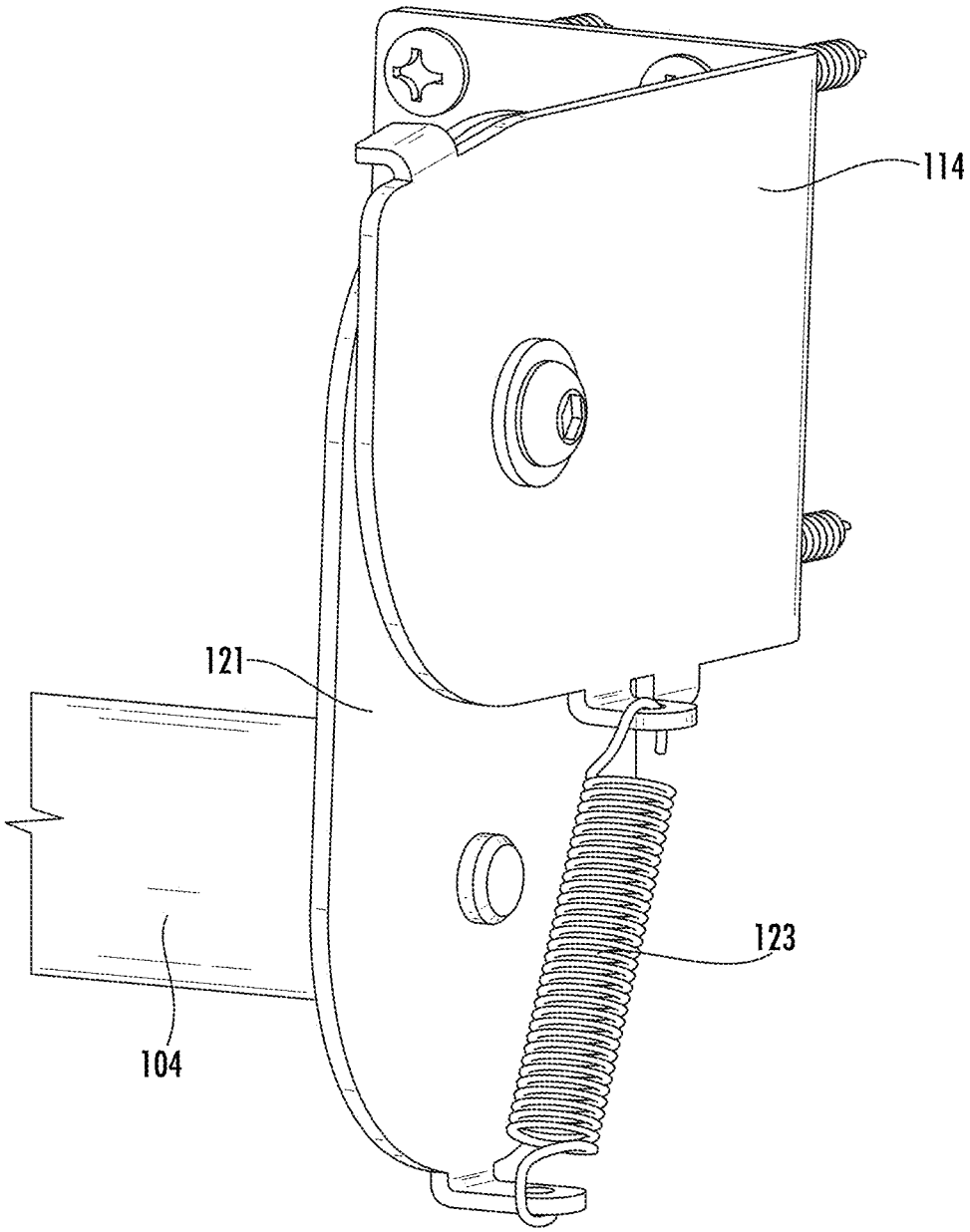
FIG. 4B is a close-up view of the top mounting bracket and extendable connector shown in FIG. 4A.

FIGS. 4A and 4B illustrate another embodiment of the extendable connector 108. As shown, the top mounting bracket 114 may be coupled to the top shield support 104 through a lever arm 121. The lever arm 121 is configured to rotate with respect to the top mounting bracket 114, allowing the top shield support 104 to move away from and toward the targeted area. A compression spring 123 may also couple the top mounting bracket 114 and the lever arm 121 together. As the lever arm 121 rotates away from the targeted area, the compression spring 123 stretches, storing energy in the compression spring 123. Thus, the lever arm 121 and the compression spring 123 together may replace or work in conjunction with the extendable connector 108. When a projectile impacts the anti-ballistic shield 102, the anti-ballistic shield 102 moves to stop the projectile. This motion rotates the lever arm 121 and stores energy in the compression spring 123, thus stopping the projectile. The different embodiments of the extendable connector 108 disclosed herein may be used separately or together in any combination in various embodiments of the anti-ballistic barrier system 100.

Figure 5B:
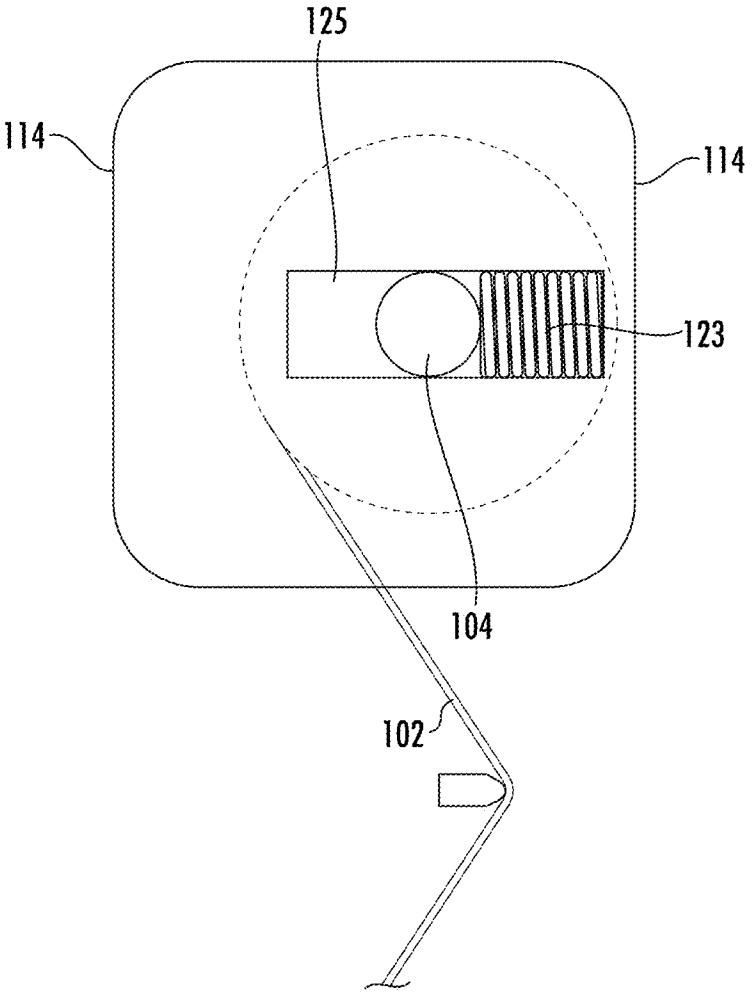
FIG. 5B is a side view of the embodiment of the top mounting bracket shown in FIG. 5A when a projectile impacts the anti-ballistic shield.
Figure 5A:
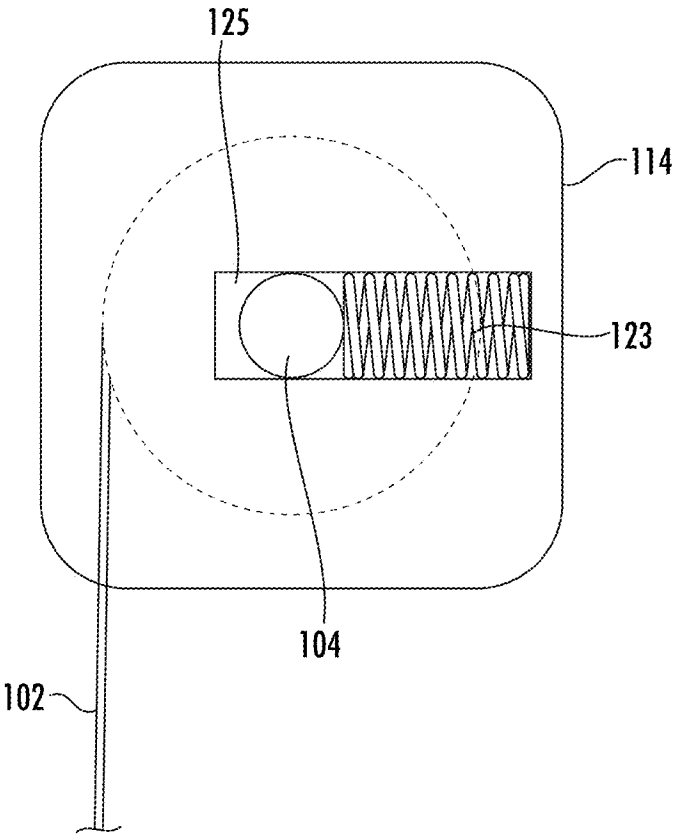
FIG. 5A is a side view of another embodiment of the top mounting bracket, where the extendable connector is a spring within a slot.

FIGS. 5A and 5B illustrate another embodiment of the extendable connector 108. As shown, the extendable connector 108 may be a compression spring 123 positioned within a slot 125. The top shield support 104 may be slidably coupled with the slot 125. Thus, when a projectile impacts the anti-ballistic shield 102, the anti-ballistic shield 102 moves to stop the projectile, as shown in FIG. 5B. This pulls the top shield support 104 toward the compression spring 123, thus storing energy from the projectile in the compression spring 123. As with other embodiments of the extendable connector 108, this helps to extend the dissipation of the projectile's energy over a greater amount of time, thus reducing the stress introduced to the top mounting bracket 114 and the bottom mounting bracket 116 and reducing the likelihood of failure of the anti-ballistic barrier system 100. The compression spring 123 could alternatively be coupled to the top shield support 104 and positioned on the other side of the top shield support 104 such that, when the projectile impacts the anti-ballistic shield 102, the compression spring 123 stretches to allow the top shield support 104 to move. Similar to other embodiments, this absorbs the energy in the projectile and allows the anti-ballistic shield 102 to stop the projectile.

Figure 6:
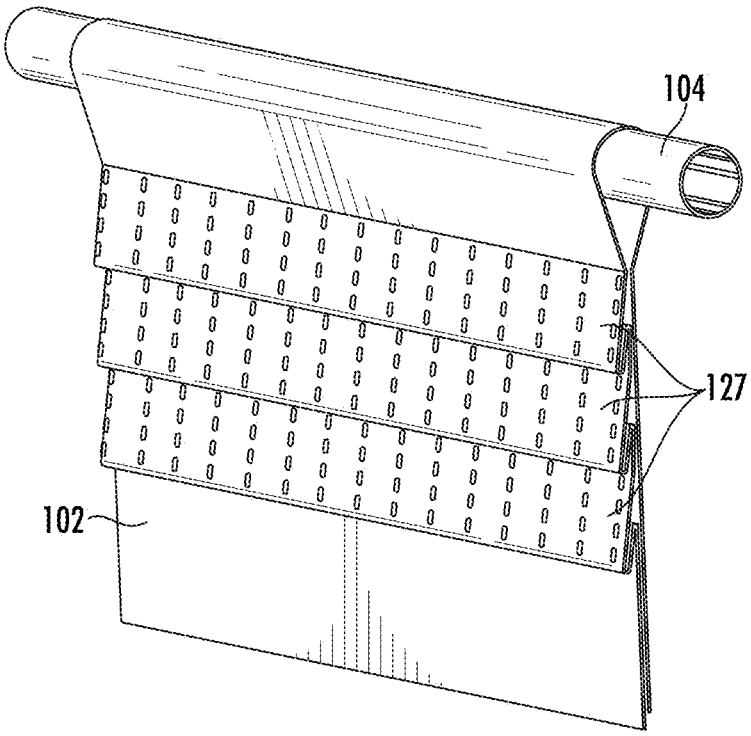
FIG. 6 is a close-up view of another embodiment of the first extendable connector, where the first extendable connector is a sewn pleated material.

As shown in FIG. 6, the extendable connector 108 may also be a plurality of pleats 127, where the anti-ballistic shield 102 is folded up and sewn to itself. The pleats 127 are configured to unfold when a projectile impacts the anti-ballistic shield 102. For this to occur, the material used to sew the pleats 127 is configured to fail. With each stitch that fails, a portion of the energy from the projectile is spent. This allows the plurality of pleats 127 to absorb the energy from the projectile until all of the pleats 127 have unfolded. As the pleats 127 unfold, the effective length of the anti-ballistic shield 102 increases, allowing the anti-ballistic shield 102 to move to stop the projectile. In this embodiment, the pleats 127 thus are permanently changed by an impact of a projectile.

Figure 7A:
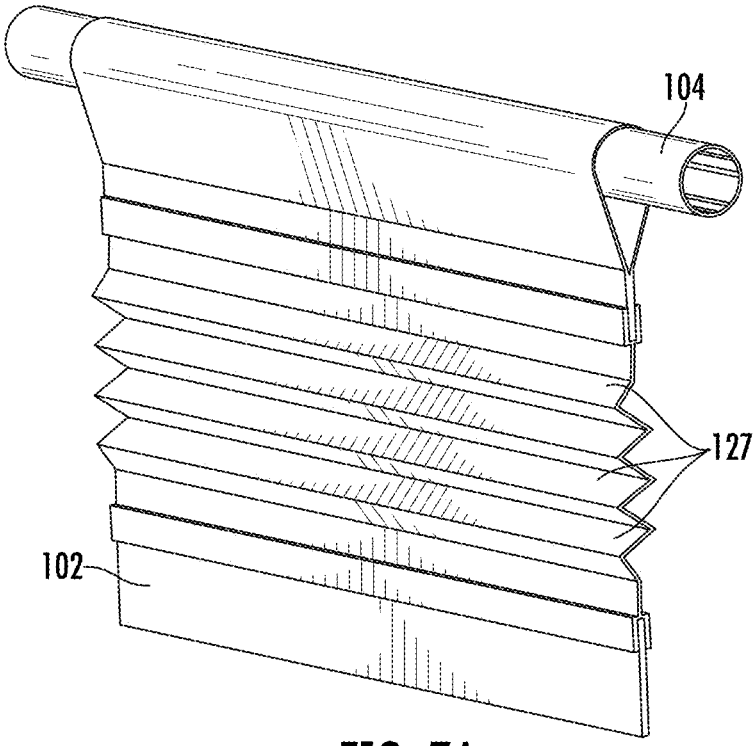
FIG. 7A is a close-up view of another embodiment of the first extendable connector, where the first extendable connector is a loose pleated material.
Figure 7B:
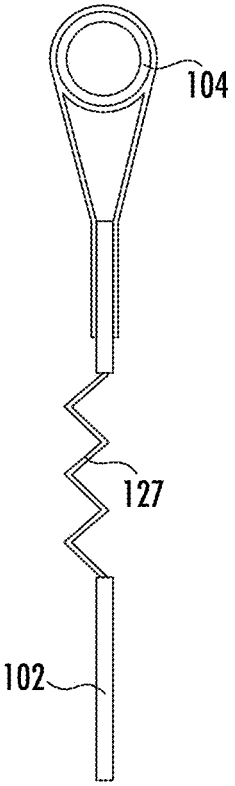
FIG. 7B is a side view of the embodiment of the first extendable connector shown in FIG. 7A prior to projectile impact.
Figure 7C:
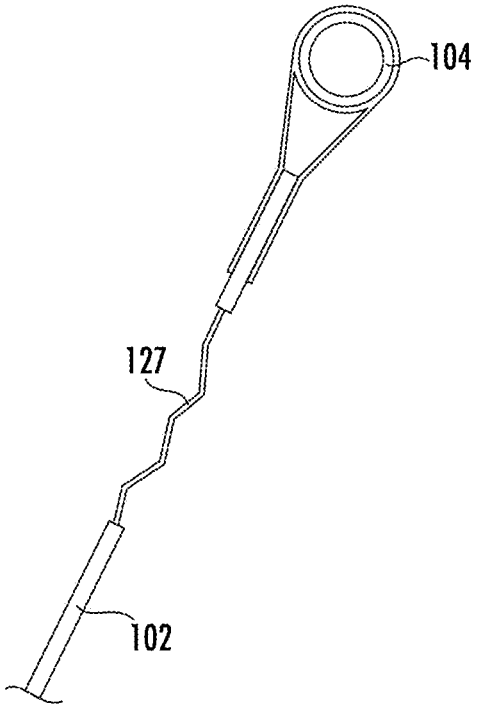
FIG. 7C is a side view of the embodiment of the first extendable connector shown in FIG. 7A during projectile impact.
Figure 8:
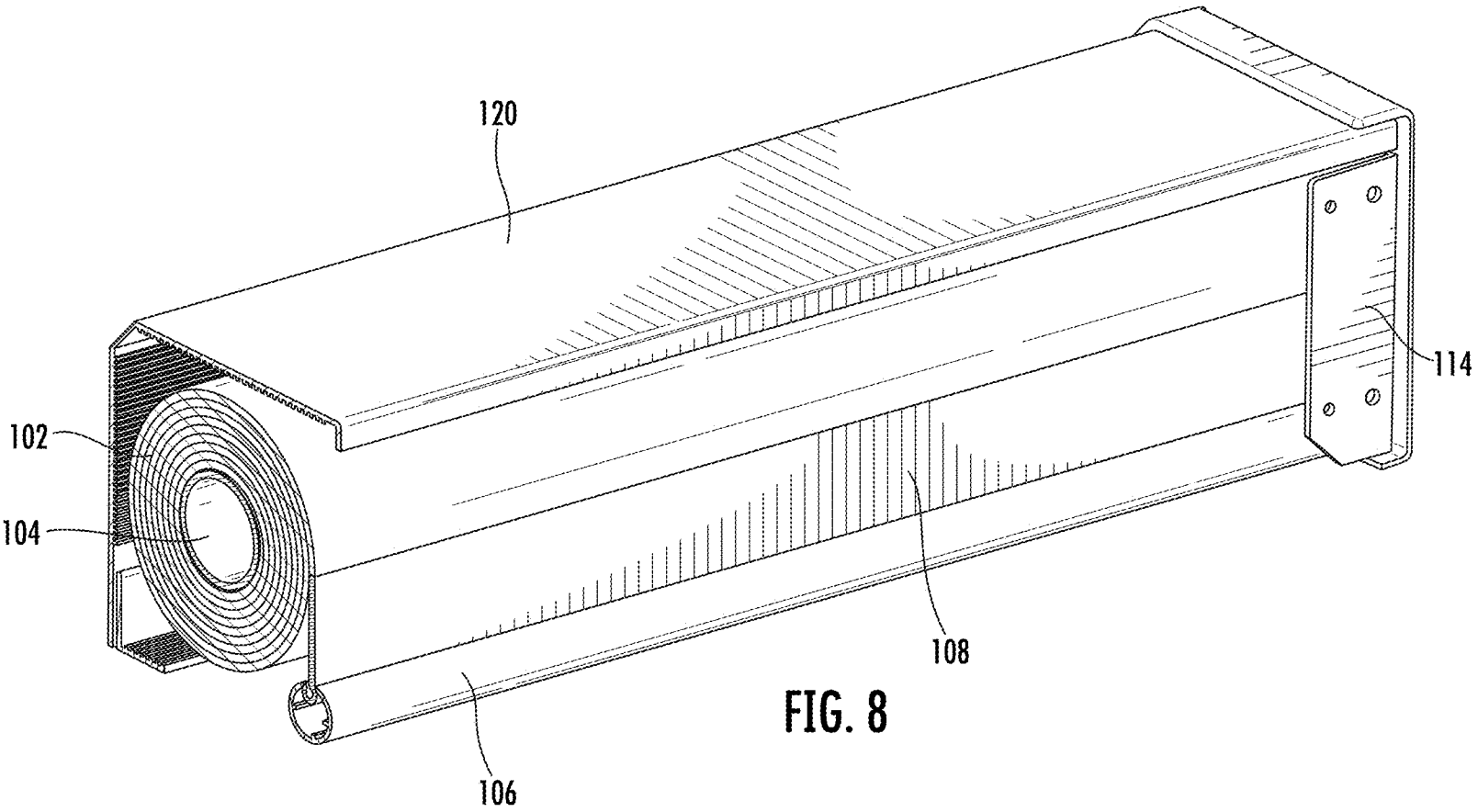
FIG. 8 is a rear perspective view of the anti-ballistic shield rolled up into the top mounting bracket and fascia, with a section cut away to expose the anti-ballistic shield wrapped around the top shield support.

FIG. 7A illustrates another embodiment of the pleats 127 which may act as the extendable connector 108. In this embodiment, different from the embodiment shown in FIG. 6, the pleats 127 are formed of a material which is biased towards the folded position. The pleats 127 may be formed of polypropylene plastic or another compliant material. Thus, prior to projectile impact, the pleats 127 are folded, as shown in FIGS. 7A and 7B. When the projectile impacts the anti-ballistic shield 102, as shown in FIG. 7C, the pleats 127 unfold, storing energy in the pleats 127. In this embodiment, once the projectile has been stopped, the pleats 127 release the energy that has been absorbed and return to the folded position, thus automatically becoming ready to absorb additional energy from projectiles if needed. As mentioned above, the different embodiments of the extendable connector 108 disclosed herein may be used separately or together in any combination in various embodiments of the anti-ballistic barrier system 100.

Figure 2:
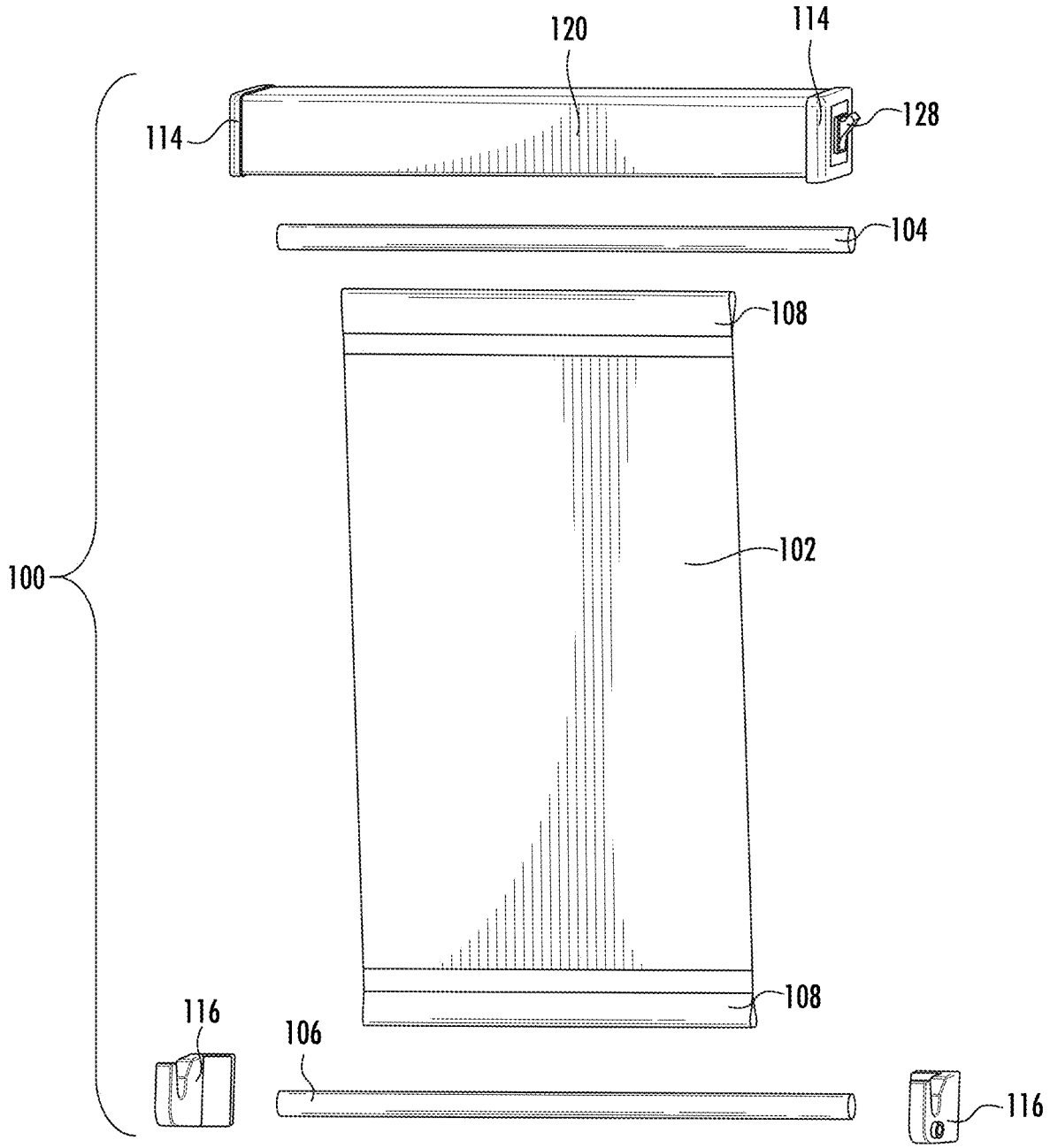
FIG. 2 is an exploded view of the anti-ballistic barrier system shown in FIG. 1.

The top mounting bracket 114 and the bottom mounting bracket 116 allow the anti-ballistic barrier system 100 to be attached to a vertical structure, such as a window 10, door 20, desk 30, wall 40, or post 50 as discussed above and as shown in FIGS. 10A-10B and 12A-15A. The top mounting bracket 114 and the bottom mounting bracket 116 may also be attached to a horizontal structure, such as a ceiling, ledge, or floor. As shown in FIGS. 1-2, the anti-ballistic barrier system 100 may have at least two top mounting brackets 114 which are joined together by a fascia 120. The fascia 120 may be sized to receive the top shield support 104, thus allowing the ends of the top shield support 104 to rotatably couple with the at least two top mounting brackets 114 and allowing the anti-ballistic shield 102 to be stored within the fascia 120 when wrapped around the top shield support 104. In some embodiments, the anti-ballistic barrier system 100 may have at least two top mounting brackets 114 without the fascia 120 extending between them. In some embodiments, the anti-ballistic barrier system 100 may have at least one top mounting bracket 114. The top shield support 104 is rotatably coupled to each of the top mounting brackets 114. This allows the top shield support 104 to rotate, which moves the anti-ballistic shield 102 between a retracted position and an extended position as disclosed in more detail below. The bottom mounting bracket 116 is configured to releasably attach the bottom shield support 106 to the vertical structure. This allows the anti-ballistic shield 102 to be anchored in the extended position, providing increased protection from projectiles, but also allows the anti-ballistic shield 102 to be released from the bottom mounting bracket 116 and wrapped around the top shield support 104 (see FIG. 8). In some embodiments, the anti-ballistic barrier system 100 has at least one bottom mounting bracket 116. Some embodiments have at least two bottom mounting brackets 116.

Figure 9:
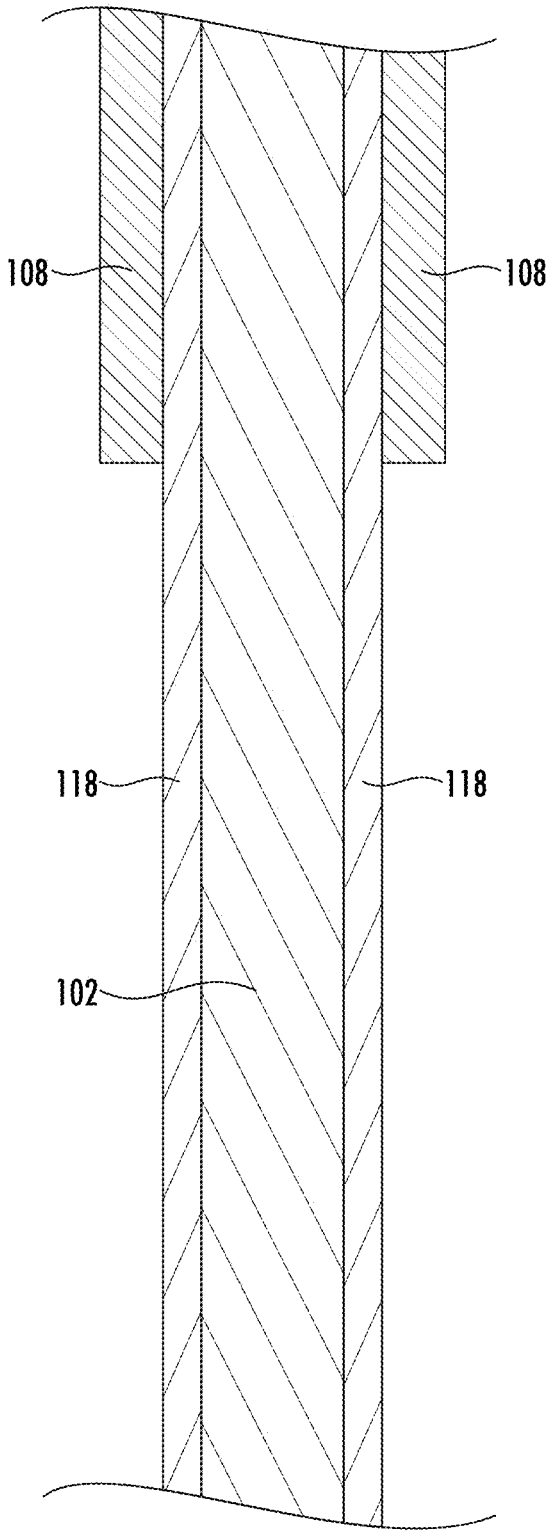
FIG. 9 is a cross-section view of the anti-ballistic shield of the anti-ballistic barrier system shown in FIG. 1.

In embodiments with the shield cover 118, the shield cover 118 extends over a majority of each of the surfaces of the anti-ballistic shield 102, such as the front and back sides of the anti-ballistic shield 102, as shown in FIG. 9. The shield cover 118 is coupled to the anti-ballistic shield 102. Because the anti-ballistic shield 102 is formed of an anti-ballistic material, such as a flexible poly-aramid anti-ballistic material, color selection may be limited. By covering the anti-ballistic shield 102 with the shield cover 118, additional colors may be available to the user. For example, the shield cover 118 may be formed of polyester, making any color available. The shield cover 118 may also be formed of a UV resistant material. Some anti-ballistic materials are susceptible to deterioration when exposed to UV rays, making the shield cover 118 more important in embodiments implementing such anti-ballistic materials exposed to UV rays. The shield cover 118 therefore may both increase the aesthetic appeal of the anti-ballistic barrier system 100 and improve the performance of the anti-ballistic barrier system 100 by limiting the exposure of the anti-ballistic shield 102 to UV rays and thus limiting deterioration of the anti-ballistic shield 102.

Figure 10A:
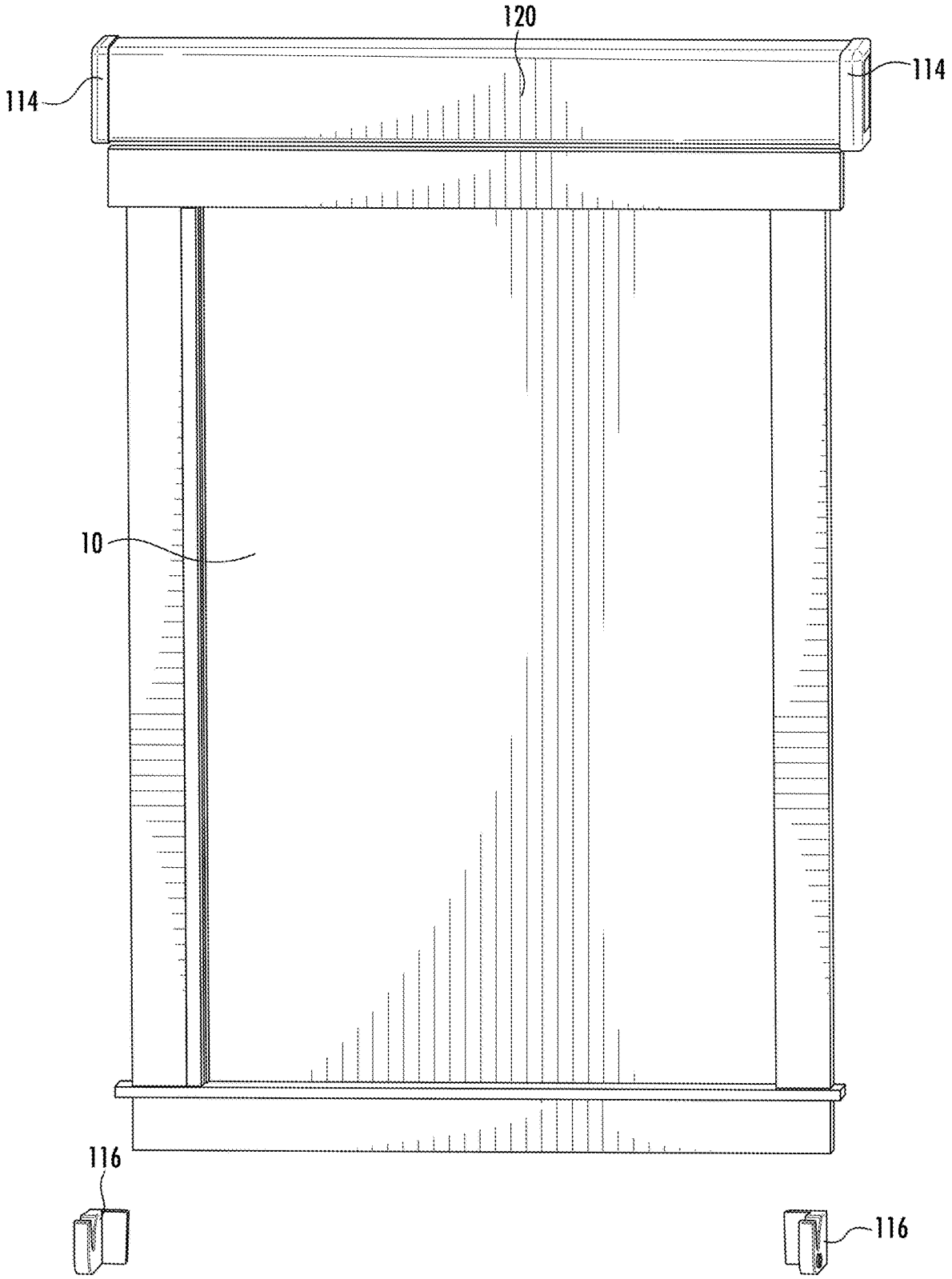
FIG. 10A is a perspective view of the anti-ballistic barrier system shown in FIG. 1 installed on a window with the anti-ballistic shield in the retracted position.
Figure 10B:
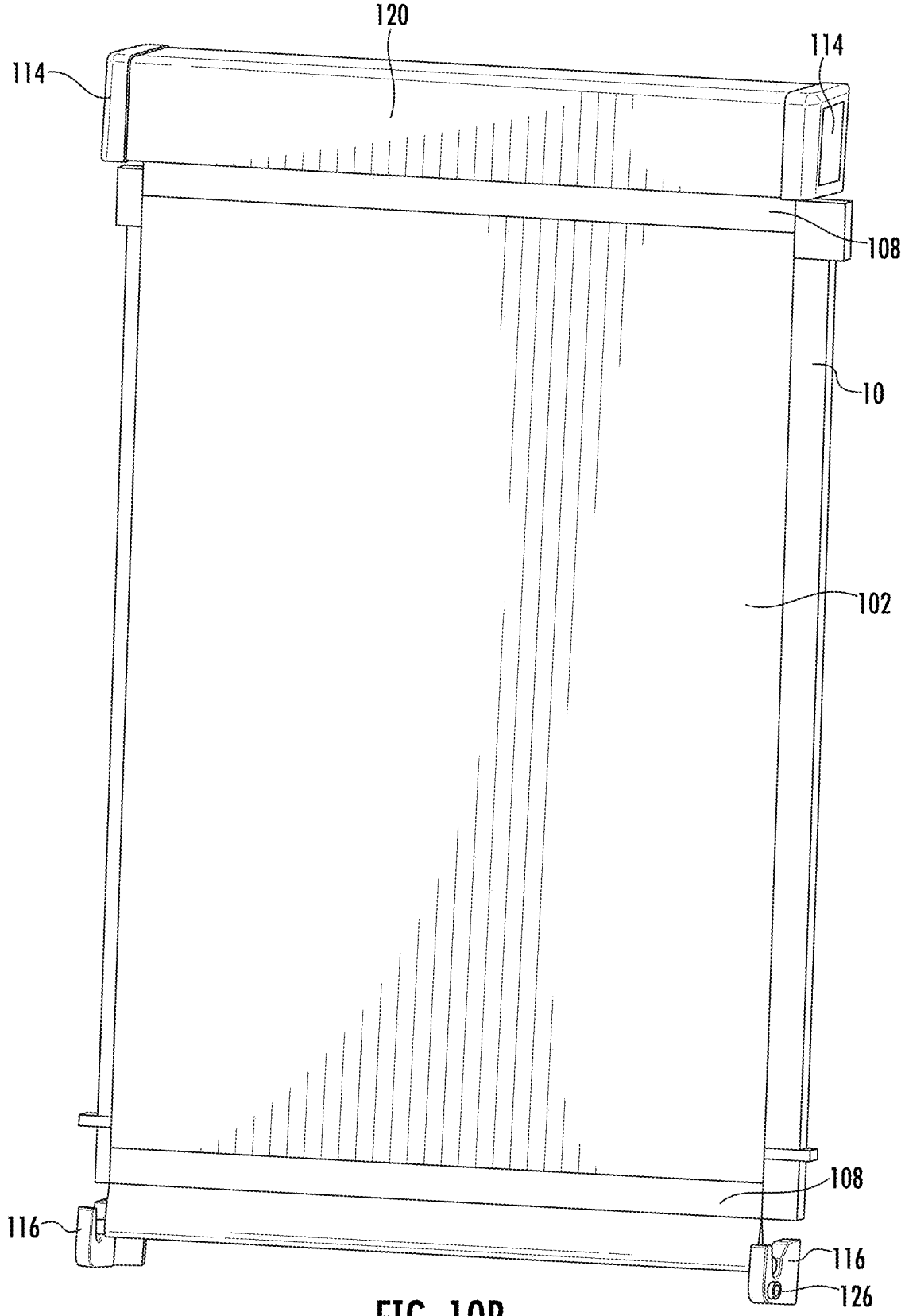
FIG. 10B is a perspective view of the anti-ballistic barrier system shown in FIG. 1 installed on a window with the anti-ballistic shield in the extended position.
Figure 10C:
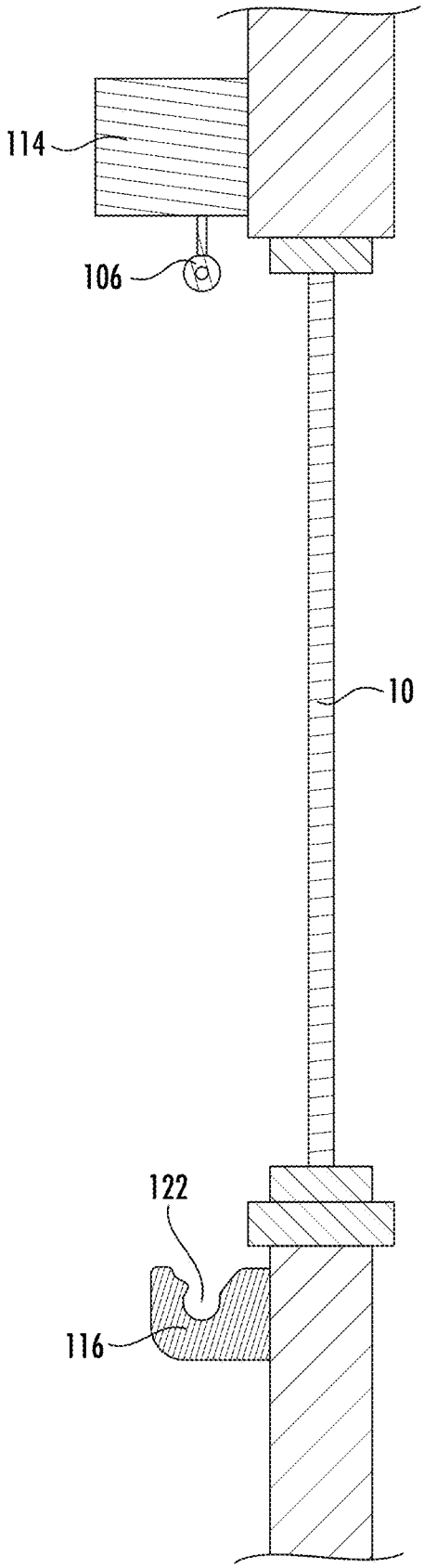
FIG. 10C is a cross-section view of the anti-ballistic barrier system installed on a window with the anti-ballistic shield in the retracted position.
Figure 10D:
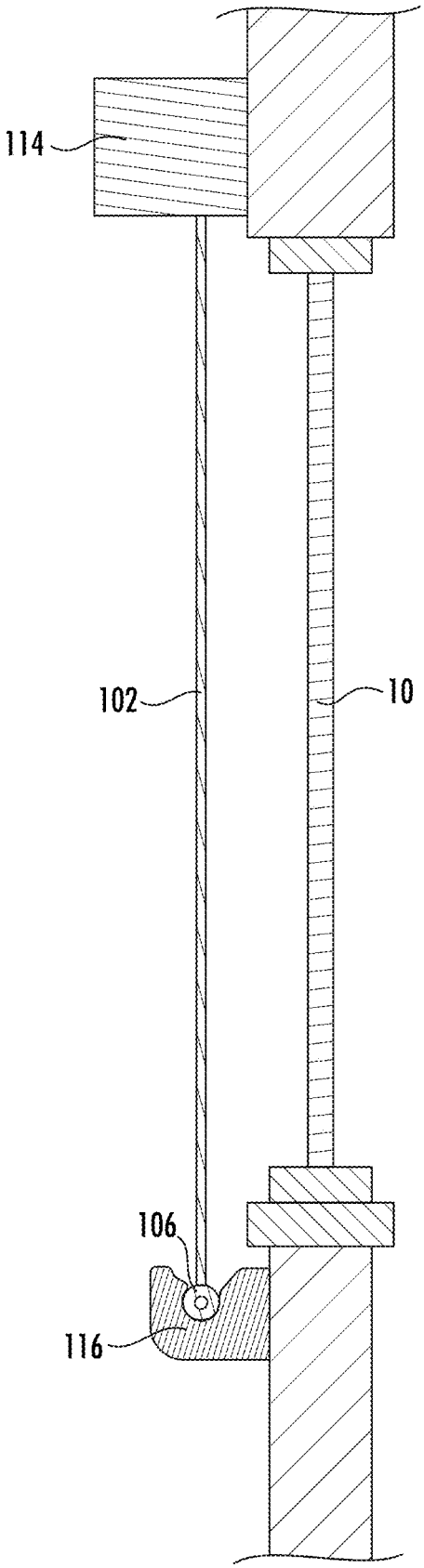
FIG. 10D is a cross-section view of the anti-ballistic barrier system installed on a window with the anti-ballistic shield in the extended position.

As mentioned above, the anti-ballistic shield 102 is movable between a retracted position and an extended position, as shown in FIGS. 10A-10D. When the anti-ballistic shield 102 is in the retracted position, a majority of the anti-ballistic shield 102 is wrapped around the top shield support 104 and the bottom shield support 106 is detached from the bottom mounting bracket 116. When the anti-ballistic shield 102 is in the extended position, a majority of the anti-ballistic shield 102 is unwrapped from the top shield support 104 and the bottom shield support 106 is engaged with the bottom mounting bracket 116 to retain the anti-ballistic shield 102 in the extended position. Thus, when the anti-ballistic barrier system 100 is not currently needed, the anti-ballistic shield 102 can be placed in the retracted position and the targeted area is left uncovered, allowing the targeted area to be used. For example, a window can provide sunlight to a room, or individuals can move through the doorway. Once there is a need for protection from projectiles, the anti-ballistic shield 102 can be moved to the extended position, covering the targeted area, as shown in FIGS. 10B and 10D. The anti-ballistic shield 102 may be lowered from the retracted position to the extended position and/or raised from the extended position to the retracted position using a motor. In some embodiments, the anti-ballistic shield 102 may be lowered from the retracted position to the extended position through the use of gravity. Other methods of raising and lowering the anti-ballistic shield 102 may also be implemented.

Figure 10E:
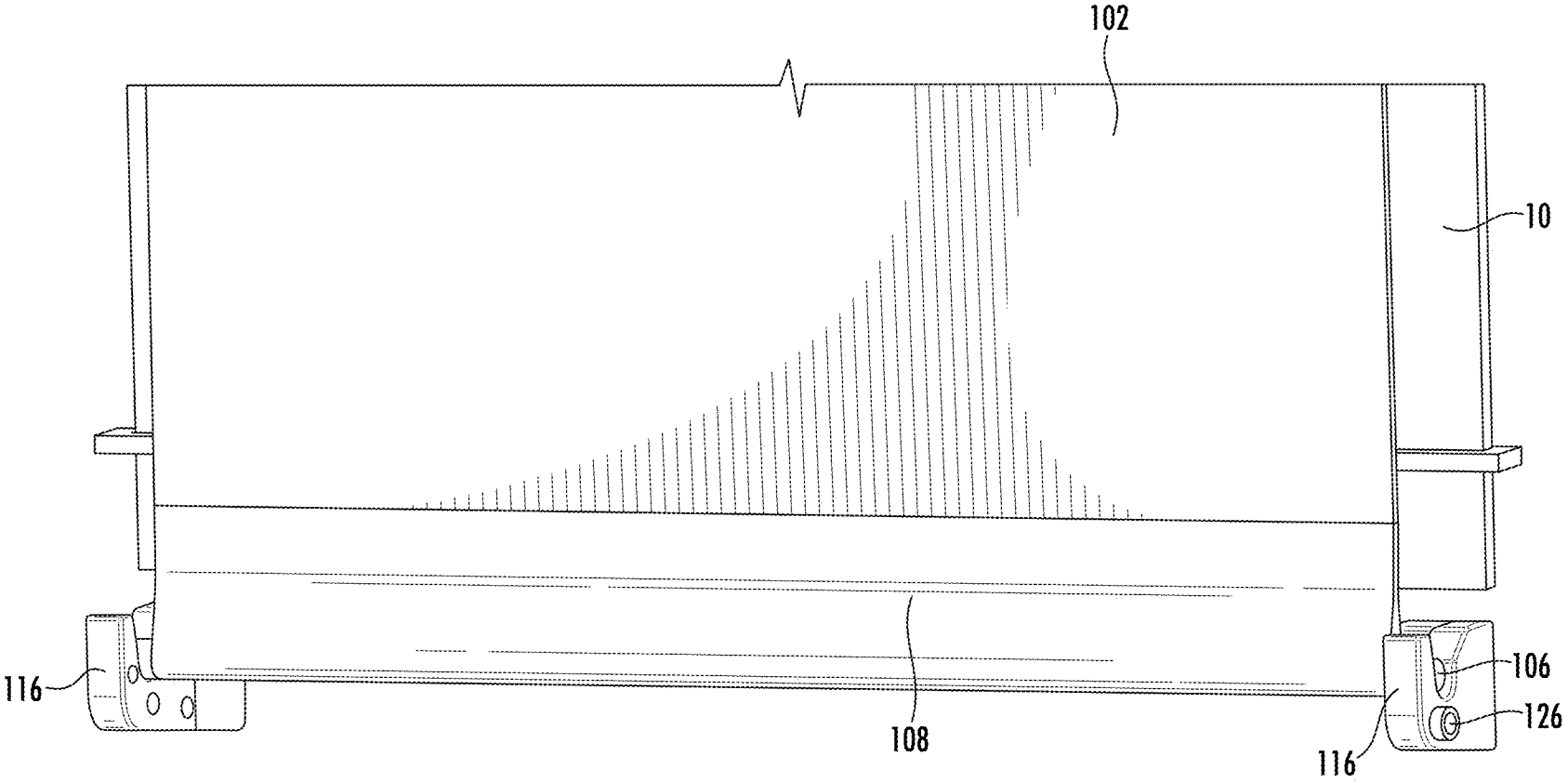
FIG. 10E is a close-up view of the anti-ballistic barrier system shown in FIG. 10A, with the bottom shield support engaged with the bottom mounting bracket.
Figure 11:
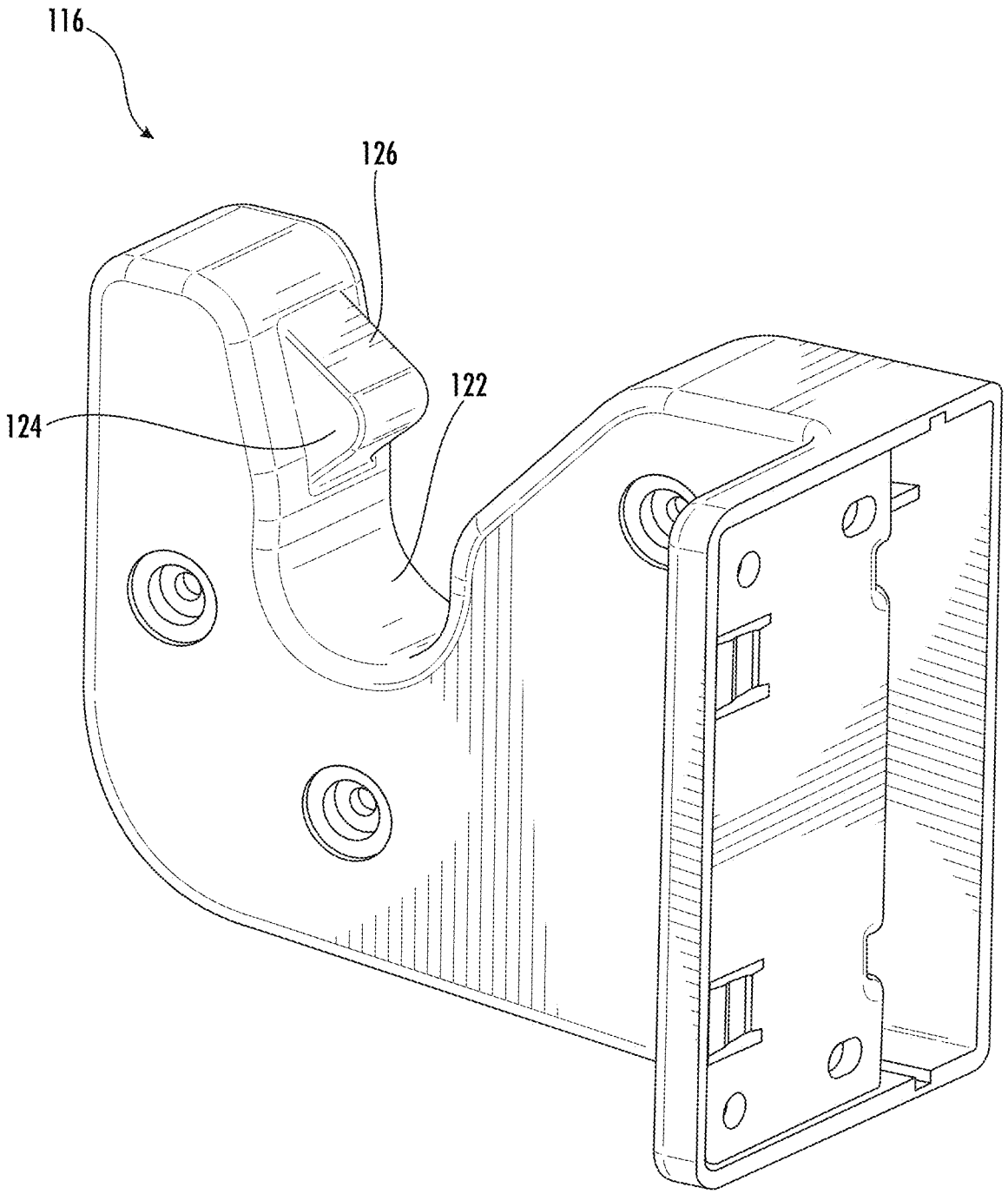
FIG. 11 is a back perspective view of the bottom mounting bracket, showing the latch operably associated with the release button which releases the bottom shield support from the bottom mounting bracket when activated.
Figure 12A:
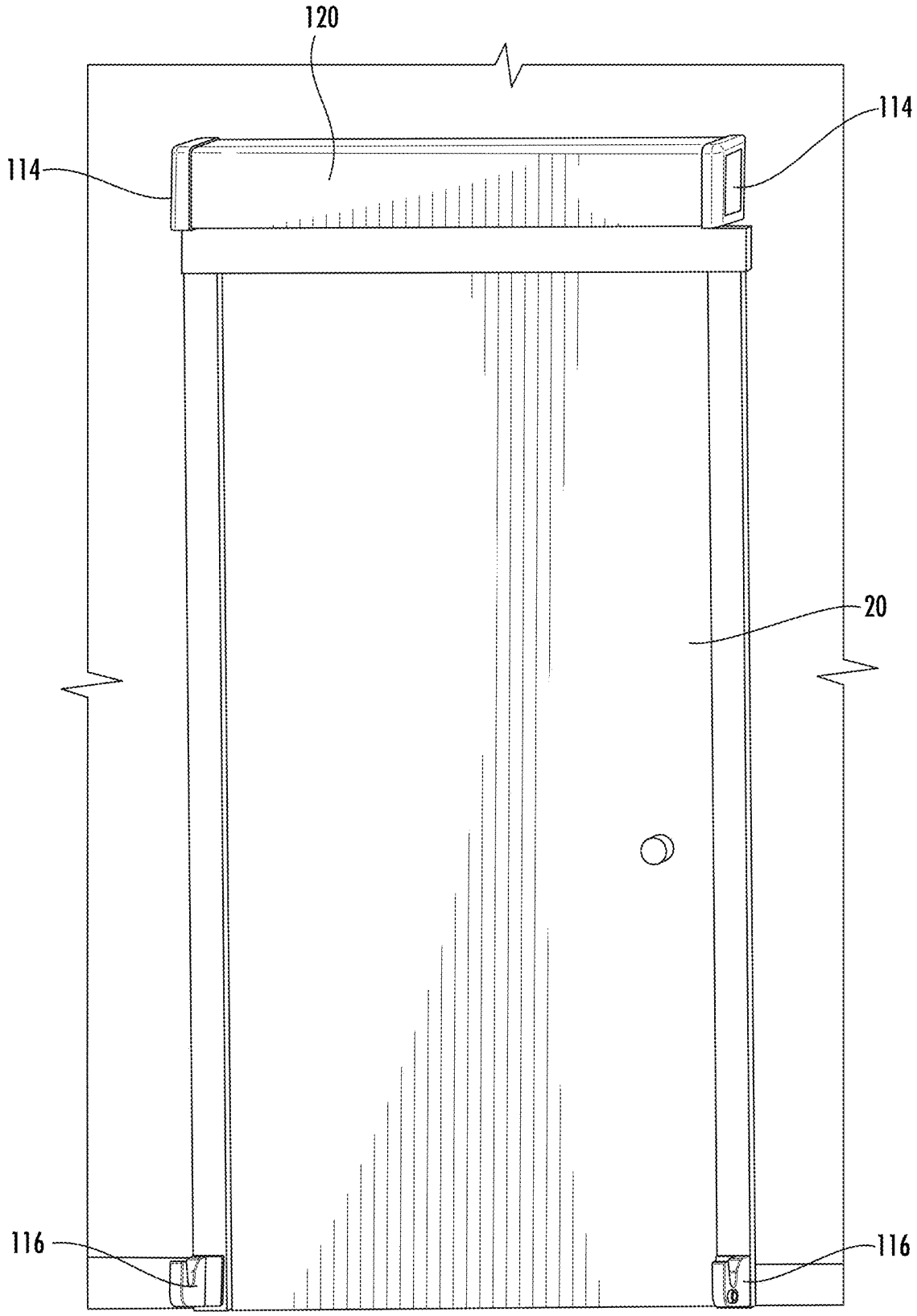
FIG. 12A is a perspective view of the anti-ballistic barrier system shown in FIG. 1 installed on a door with the anti-ballistic shield in the retracted position.
Figure 12B:
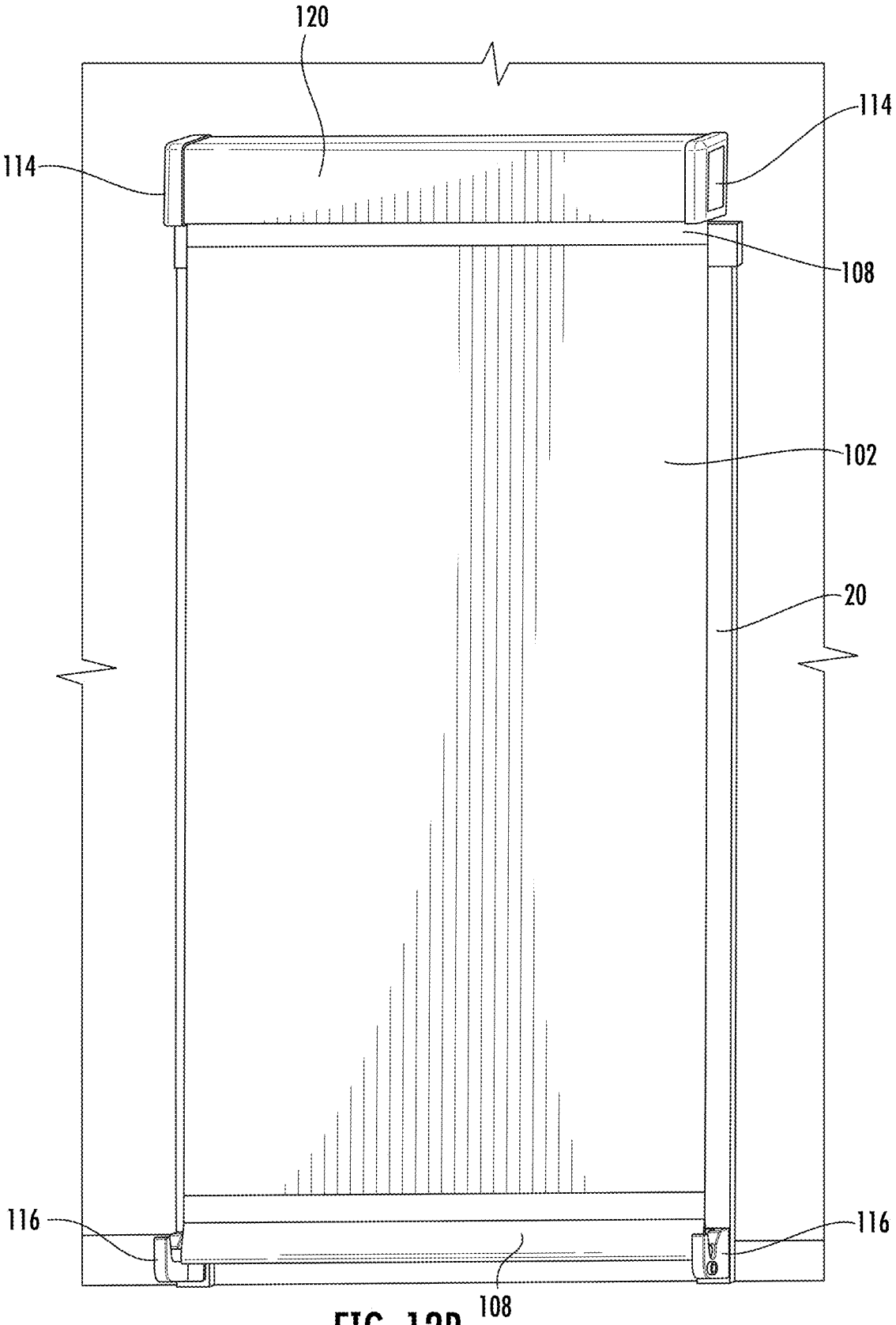
FIG. 12B is a perspective view of the anti-ballistic barrier system shown in FIG. 1 installed on a door with the anti-ballistic shield in the extended position.
Figure 13A:
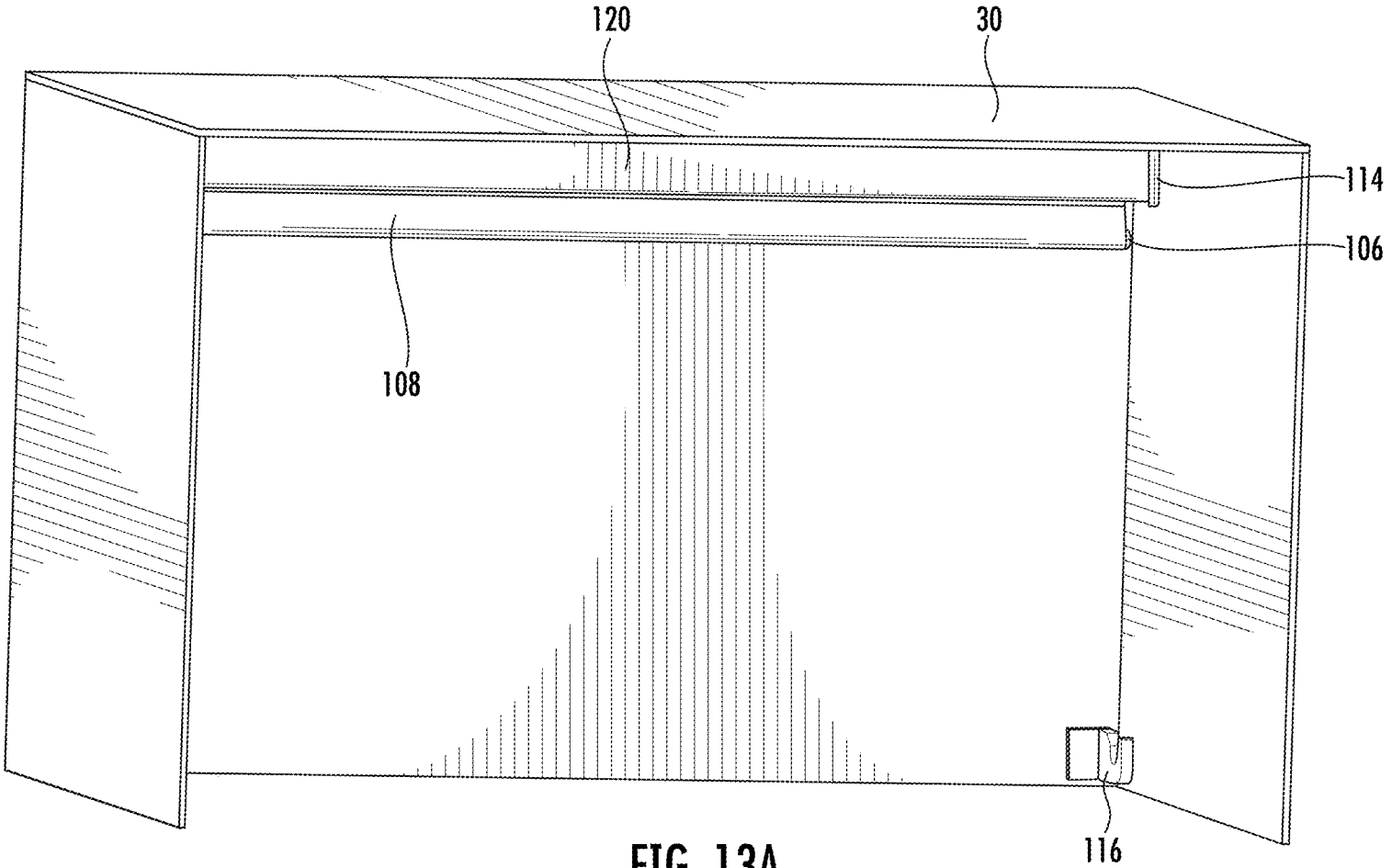
FIG. 13A is a perspective view of the anti-ballistic barrier system shown in FIG. 1 installed on a desk with the anti-ballistic shield in the retracted position.
Figure 13B:
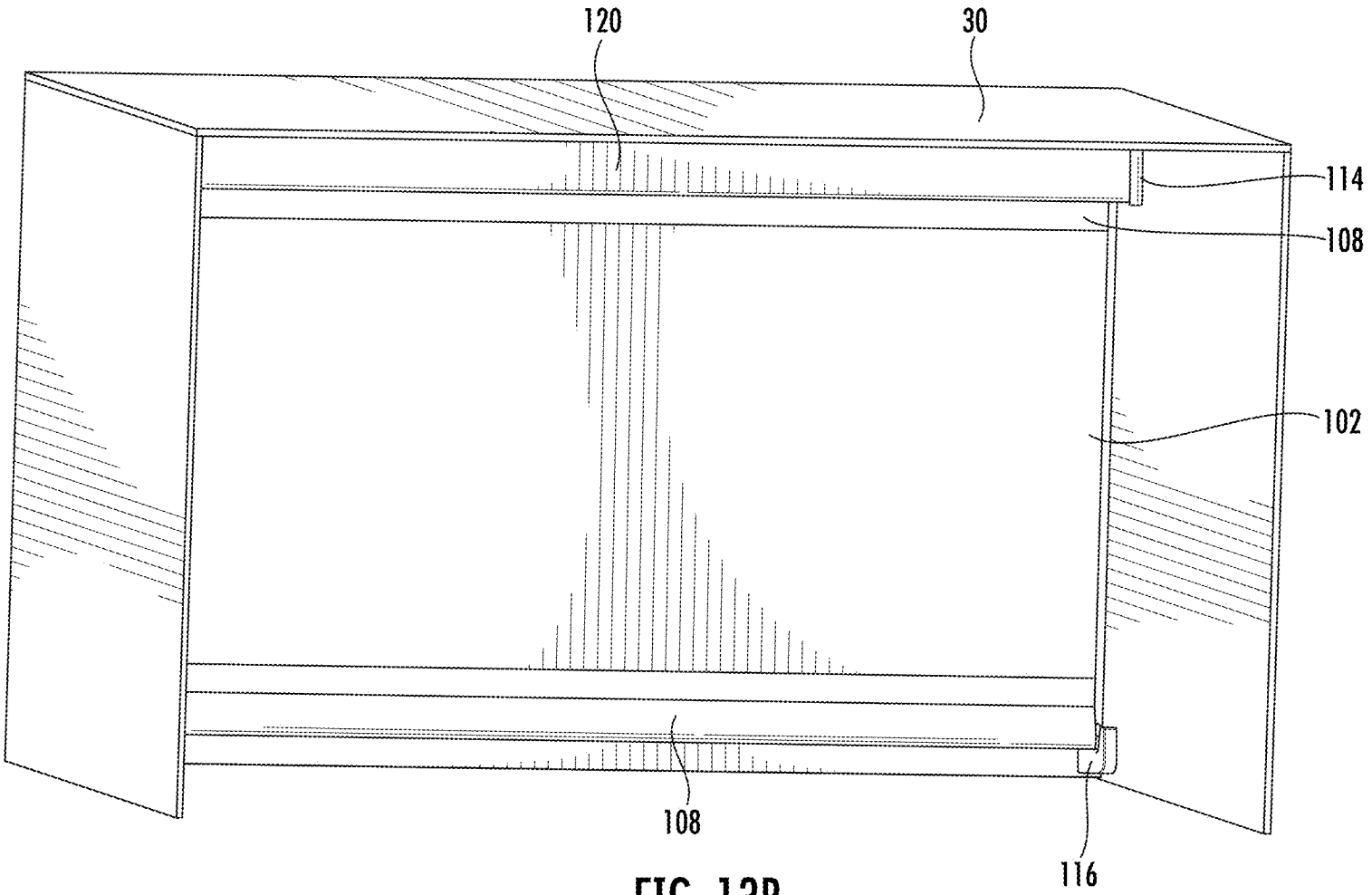
FIG. 13B is a perspective view of the anti-ballistic barrier system shown in FIG. 1 installed on a desk with the anti-ballistic shield in the extended position.
Figure 14A:
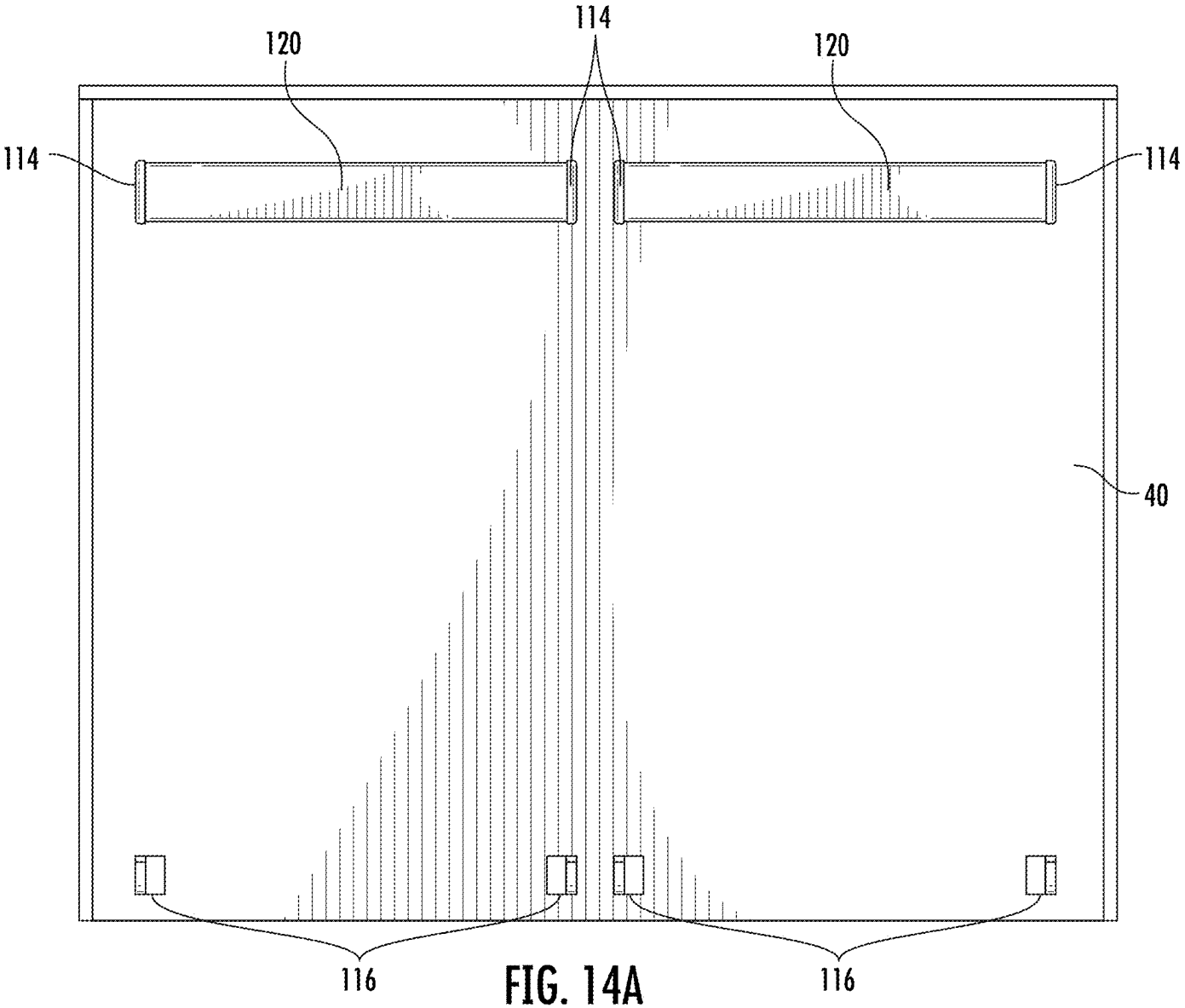
FIG. 14A is a perspective view of the anti-ballistic barrier system shown in FIG. 1 installed on a wall with the anti-ballistic shield in the retracted position.
Figure 14B:
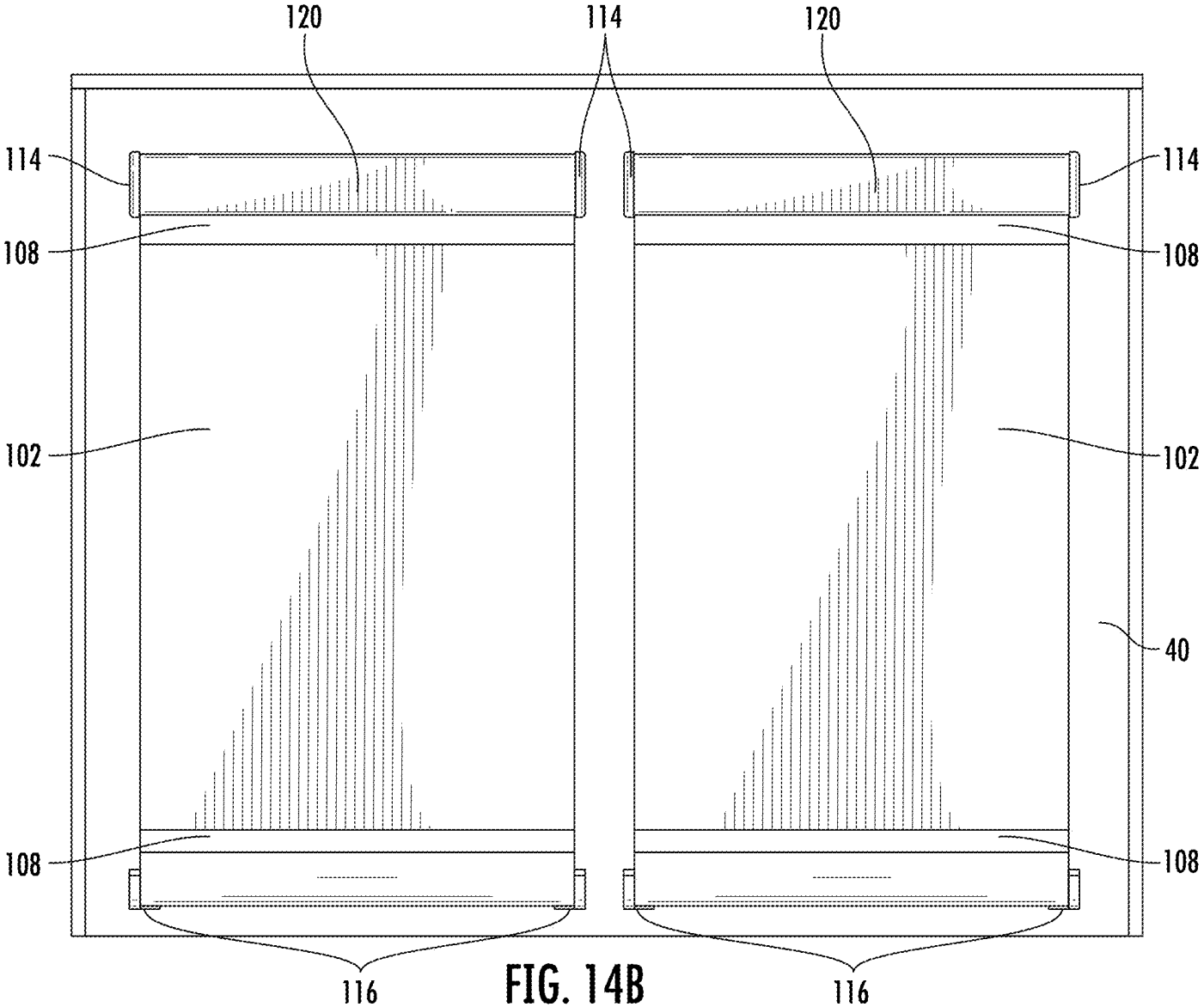
FIG. 14B is a perspective view of the anti-ballistic barrier system shown in FIG. 1 installed on a wall with the anti-ballistic shield in the extended position.

In embodiments of the anti-ballistic barrier system 100 in which the bottom shield support 106 is not engaged with the bottom mounting bracket 116 when the anti-ballistic shield 102 is in the extended position, the anti-ballistic barrier system 100 may be vulnerable to multiple projectiles that follow each other in quick succession. When the first projectile impacts the anti-ballistic shield 102, the energy from the projectile transfers to the anti-ballistic shield 102, often causing the anti-ballistic shield 102 to lift up or rotate away from the targeted area. This leaves the targeted area open for additional projectiles to pass through if timed correctly. In embodiments of this disclosure, the bottom shield support 106 engages with the bottom mounting bracket 116 when the anti-ballistic shield 102 is in the extended position, as shown in FIG. 10E. The bottom shield support 106 may engage with the bottom mounting bracket 116 automatically through the force of gravity or through motorized movement of the bottom shield support 106 to the bottom mounting bracket 116. The bottom shield support 106 may also engage with the bottom mounting bracket 116 through an automated mechanism or a button, lever, switch, or catch which can be electronically or manually engaged. FIG. 11 illustrates one method of engaging the bottom shield support 106 with the bottom mounting bracket 116. As shown, the bottom shield support 106 may press into the cup 122 of the bottom mounting bracket 116 by passing the catch 124. The catch 124 then retains the bottom shield support 106 within the bottom mounting bracket 116 despite projectiles impacting the anti-ballistic shield 102.

The anti-ballistic barrier system 100 may comprise a release button 126 that is operably associated with the bottom mounting bracket 116. The release button 126 is configured to release the bottom shield support 106 from the bottom mounting bracket 116 when activated. The release button 126 may be located on the bottom mounting bracket 116 or elsewhere. For example, the release button 126 may be integral with the catch 124 itself. The catch 124 may be configured to resist movement in the upward direction and welcome movement in the downward direction so that even while the anti-ballistic shield 102 is catching projectiles, the bottom shield support 106 does not push the catch 124 upward to release the bottom shield support 106, but a user can press the catch 124 downward or inward toward the bottom mounting bracket 116 to allow the bottom shield support 106 to disengage from the bottom mounting bracket 116. Thus, the release button 126 and the catch 124 may be integral to each other. Alternatively, the release button 126 may be located elsewhere and be mechanically or electrically coupled to the catch 124 to release the bottom shield support 106 from the bottom mounting bracket 116 when activated, as shown in FIG. 10E.

The anti-ballistic barrier system 100 may also comprise an anti-ballistic shield release 128 that is configured to release the anti-ballistic shield 102 from the retracted position upon activation. The anti-ballistic shield release 128 may be configured to automatically release the anti-ballistic shield 102 from the retracted position in response to at least one environmental change detected. This allows the anti-ballistic barrier system 100 to monitor the surroundings and environment of the anti-ballistic barrier system 100 and react to changes faster than if the anti-ballistic barrier system 100 waited for instruction to do so. The anti-ballistic barrier system 100 may monitor the environment through the use of sensors such as cameras, microphones, motion sensors, heat sensors, accelerometers, etc. Thus, examples of environmental changes which might lead to the anti-ballistic shield release 128 automatically releasing the anti-ballistic shield 120 from the retracted position include a noise, a glass break sound, or a pre-determined frequency. Other examples of environmental changes include storm warnings, alarms, and rapid movements outside a building in which one or more anti-ballistic barrier systems 100 are installed.

The anti-ballistic shield release 128 may also be manually operated such that a user could release the anti-ballistic shield 102 from the retracted position whenever desired. For example, the anti-ballistic shield release 128 may be configured as a quick release lever, button, or switch that is operably associated with the top shield support 104, as shown in FIG. 1. Thus, once the anti-ballistic shield release 128 is activated, the anti-ballistic shield 102 is released from the retracted position and is moveable to the extended position. The anti-ballistic barrier system may also comprise a pull chord 130 operably associated with the top shield support 104 similar to existing window shades. The pull chord 130 may be configured to raise the anti-ballistic shield 102 from the extended position to the retracted position upon activation. A motor may also be implemented to raise the anti-ballistic shield 102 from the extended position to the retracted position.

As disclosed above, different embodiments of the anti-ballistic barrier system 100 may implement different methods of moving the anti-ballistic shield 102 between the retracted position and the extended position. The overarching goal of these different methods is to provide flexibility to the user so that the anti-ballistic barrier system 100 can be implemented to provide protection quickly and efficiently. Sometimes, this means that the user manually moves the anti-ballistic shield 102 to cover the targeted area. In other cases, this means that the anti-ballistic barrier system 100 automatically moves the anti-ballistic shield 102 to cover the targeted area. In yet other cases, the anti-ballistic barrier system 100 may be permanently deployed and is moved to its retracted position only when transporting and installing the anti-ballistic barrier system 100. Other methods, procedures, and mechanisms for performing the same task will be apparent to those of skill in the art, and all are considered to be within the scope of this disclosure.

Figure 16:
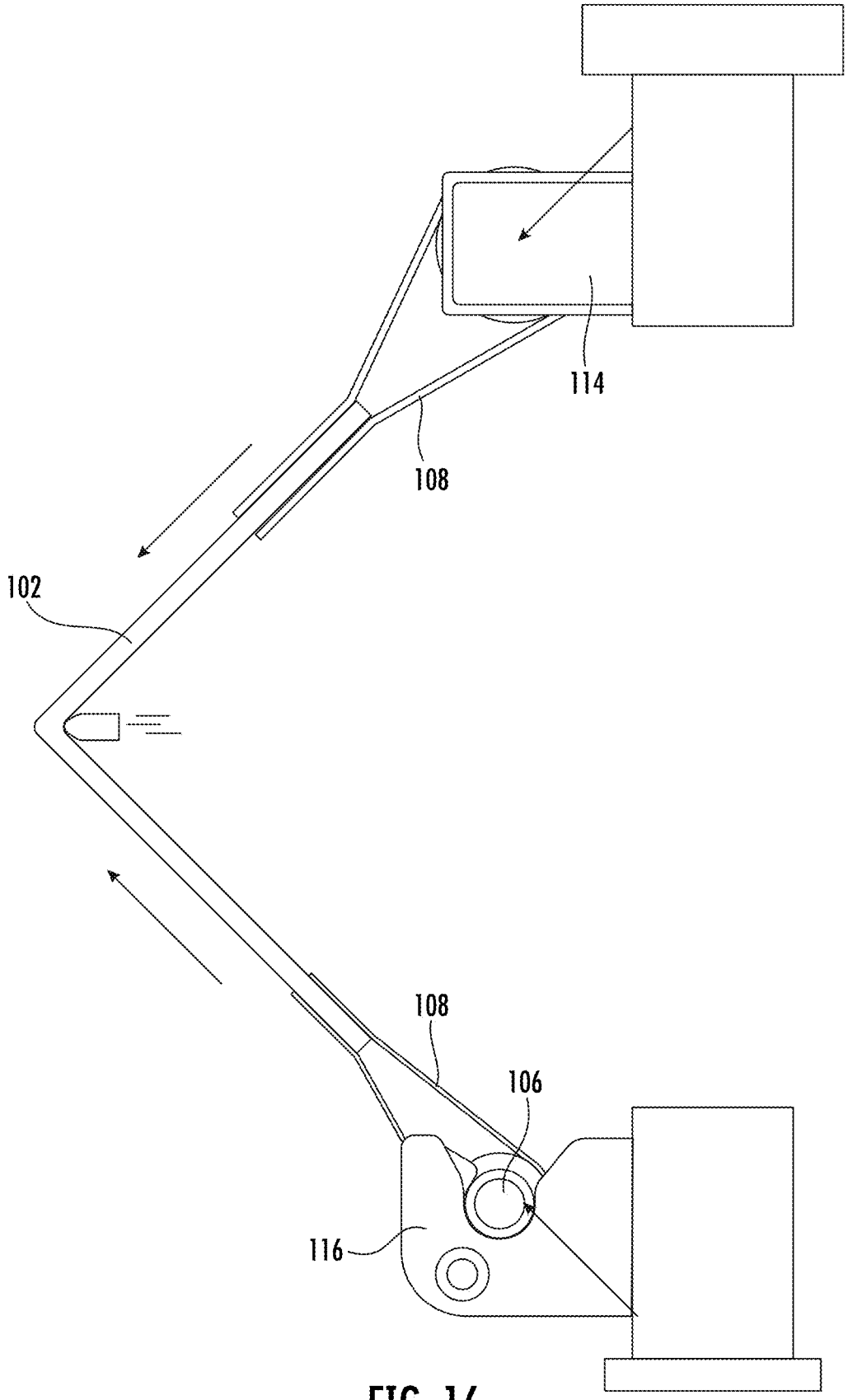
FIG. 16 is a side view of the anti-ballistic barrier system shown in FIG. 1 in the extended position being impacted by a projectile.

FIG. 16 illustrates the anti-ballistic barrier system 100 when impacted by a projectile. As shown and as previously disclosed, the anti-ballistic shield 102 is configured to catch the projectile and dissipate the energy within the projectile to remove the threat posed by the projectile. Thus, upon impact, the anti-ballistic shield 102 moves with the projectile, stretching the extendable connectors 108. The extendable connectors 108 extend or stretch, dissipating a portion of the energy from the projectile and transferring the remaining energy into the vertical structure though the top shield support 104 and top mounting bracket 114, and the bottom shield support 106 and bottom mounting bracket 116. The extendable connectors 108 significantly reduce the strain on the top mounting bracket 114 and the bottom mounting bracket 116 because the energy from the projectile's impact is stretched over a greater amount of time. Without the extendable connectors 108, all of the force of the impact would have to be absorbed relatively quickly, which would increase the strength required for the top mounting bracket 114 and the bottom mounting bracket 116 to remain secured to the vertical surface. By including at least one extendable connector 108 between the anti-ballistic shield 102 and either the bottom shield support 106 or the top shield support 104, the strength required for the top mounting bracket 114 and the bottom mounting bracket 116 to remain secured to the vertical surface is reduced, thus improving the security provided by the anti-ballistic barrier system 100.

Figure 15A:
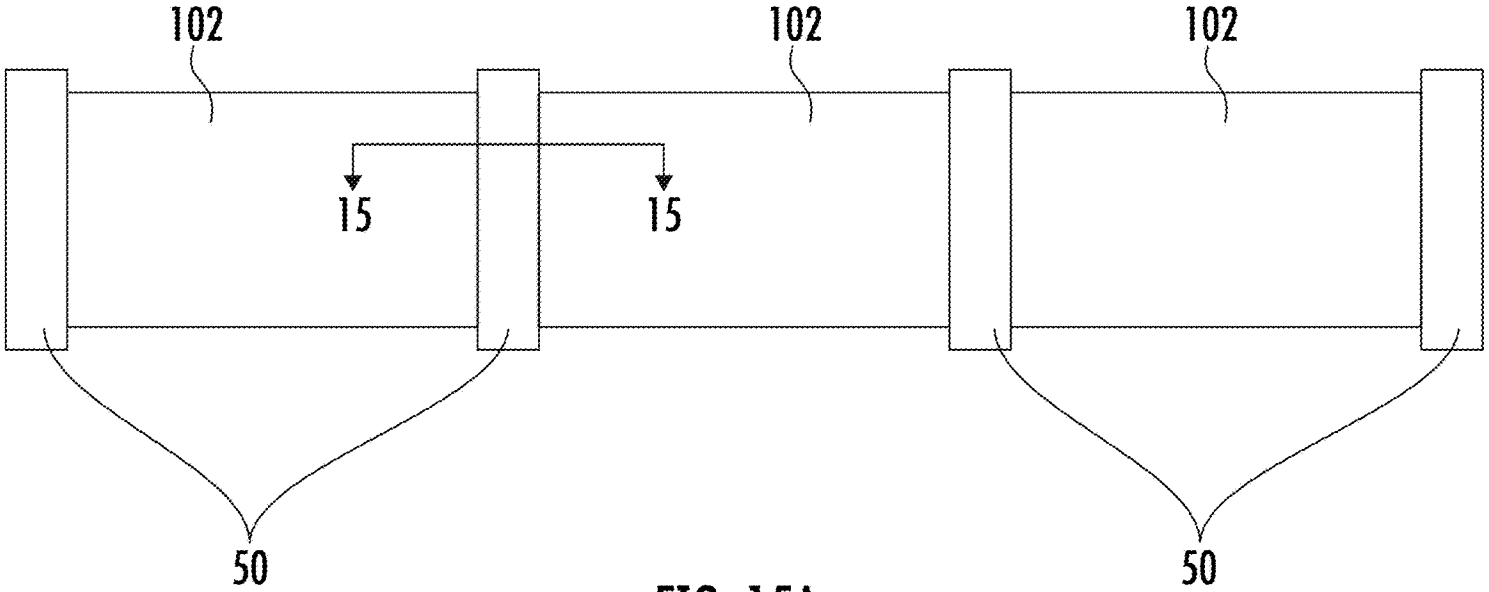
FIG. 15A is a front view of multiple systems of the anti-ballistic barrier system shown in FIG. 1 installed horizontally between posts.

The anti-ballistic barrier system 100 may be temporary or may be permanent. For example, in embodiments configured as barricades, the anti-ballistic barrier system 100 may comprise a plurality of posts 50 with the targeted area extending between the two posts 50, as shown in FIG. 15A. The posts 50 may be movable such that the anti-ballistic barrier system 100 can be placed wherever is needed. Alternatively, the posts 50 may be fixed, with the anti-ballistic barrier system 100 configured to cover the targeted area between the posts 50 when needed. In addition, the anti-ballistic barrier system 100 may be configured to unroll down from the top mounting bracket 114 to couple with the bottom mounting bracket 116 as disclosed above. Alternatively, the anti-ballistic barrier system 100 may be configured to deploy from one side of the system 100 and extend across to the other side of the system 100. In such an embodiment, the anti-ballistic barrier system 100 may have a track extending across the top of the anti-ballistic barrier system 100 to guide the anti-ballistic shield 102 across the anti-ballistic barrier system 100.

Figure 15B:
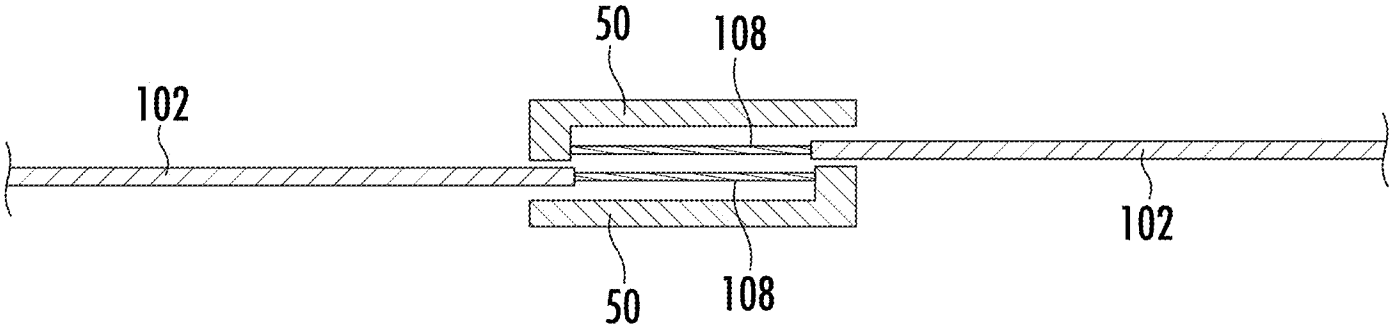
FIG. 15B is a cross section view of one embodiment of the post shown in FIG. 15A taken along line 15-15.
Figure 15C:
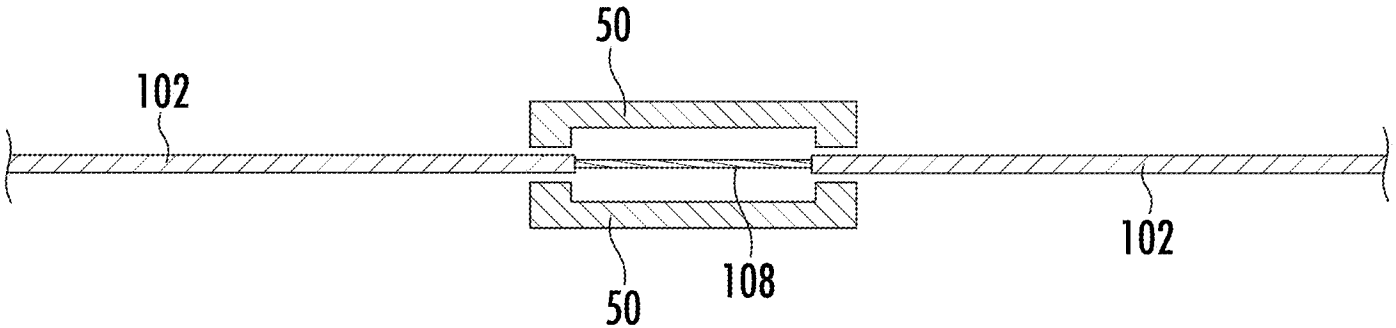
FIG. 15C is a cross section view of another embodiment of the post shown in FIG. 15A taken along line 15-15.
Figure 15D:
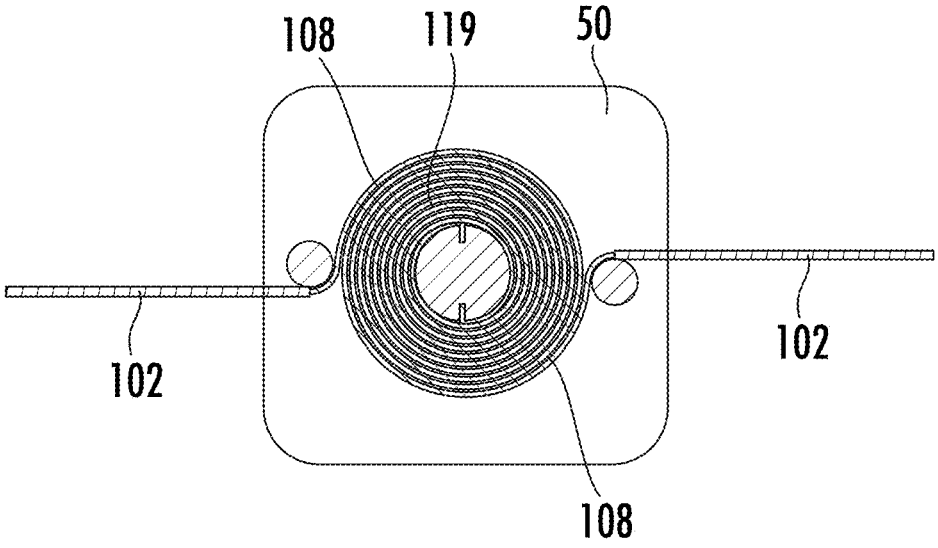
FIG. 15D is a cross section view of another embodiment of the post shown in FIG. 15A taken along line 15-15.

FIGS. 15B, 15C, and 15D illustrate various embodiments of the anti-ballistic barrier system shown in FIG. 15A, each attached to the post 50 in a different configuration. As shown in FIGS. 15B and 15C, the extendable connector 108 may be completely contained within the post 50, thus allowing the post 50 to protect the extendable connector 108 from being targeted by a projectile. The extendable connector 108 may be separate for each segment of the anti-ballistic shield 102, as shown in FIG. 15B, or may be joined together, where each anti-ballistic shield 102 shares an extendable connector 108 with adjacent anti-ballistic shields 102, as shown in FIG. 15C. Additionally, as described above with reference to vertical anti-ballistic barrier systems 100, a torsion spring 119 may also be implemented within the post 50 to allow the anti-ballistic shield 102 to unwind and recoil during projectile impact.

FIGS. 18 through 21D illustrate additional embodiments of anti-ballistic barriers. Any of the features shown or discussed above with reference to the anti-ballistic barrier system 100 may also be implemented in the embodiments shown in FIGS. 1-17. Additionally, any of the features shown or discussed with reference to the anti-ballistic barrier systems shown in FIGS. 1-17 may be implemented the embodiments shown in FIGS. 18 through 21D. As will be clear to one of ordinary skill in the art, the different features disclosed herein may be adapted to fit with different embodiments and different circumstances as needed for any of the embodiments illustrated or contemplated herein or derived from this disclosure. The drawings show specific embodiments by example, and not by limitation.

Figure 18:
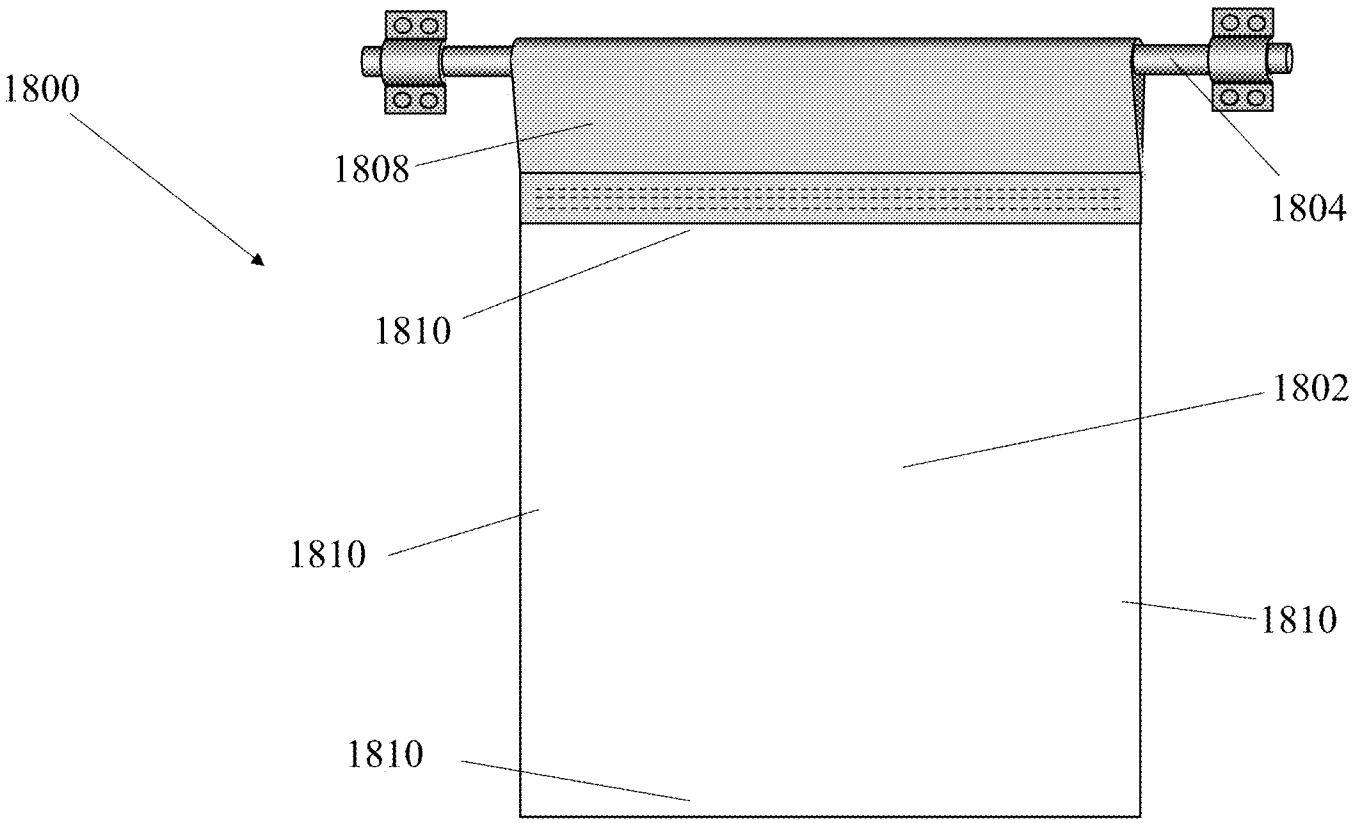
FIG. 18 is a perspective view of another embodiment of an anti-ballistic barrier system with at least one extendable connector.

FIG. 18 illustrates an anti-ballistic barrier system 1800 with an anti-ballistic shield 1802, at least one support mount 1804, or a plurality of support mounts 1804, and an extendable connector 1808. Similar to the anti-ballistic barrier system 100 disclosed above, the anti-ballistic shield 1802 may be formed of an anti-ballistic material and may be attached to the support mount 1804 through the extendable connector 1808, and the support mount 1804 may be attached to the support structure. The shield 1802 is configured to extend across a targeted area to protect against projectiles. As explained above, in some embodiments, the shield 102 may be attached to the support structure along two sides 1810 of the shield 102. As shown in FIG. 18, the shield 1802 may also be attached to the support structure along only one side 1810 of the shield 1802. This may be because the shield 1802 is large enough or heavy enough that the shield 1802 is held in place while being impacted by projectiles simply by the weight of the shield 1802, or for some other reason. Additionally, the area near the bottom of the shield 1802 may present a reduced risk of serious injury, and it, therefore, may be less important for the shield 1802 to protect that portion of the targeted area.

Figure 19A:
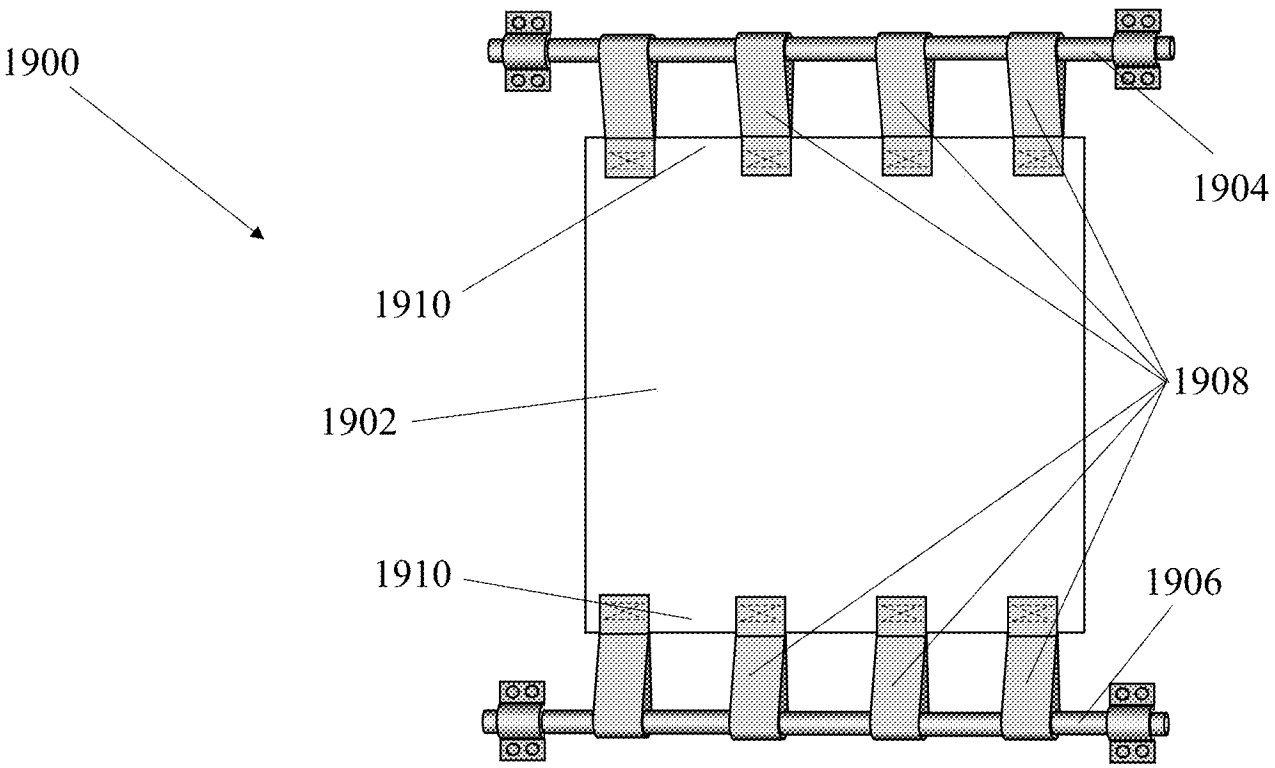
FIG. 19A is a perspective view of another embodiment of an anti-ballistic barrier system with a plurality of extendable connectors.
Figure 19B:
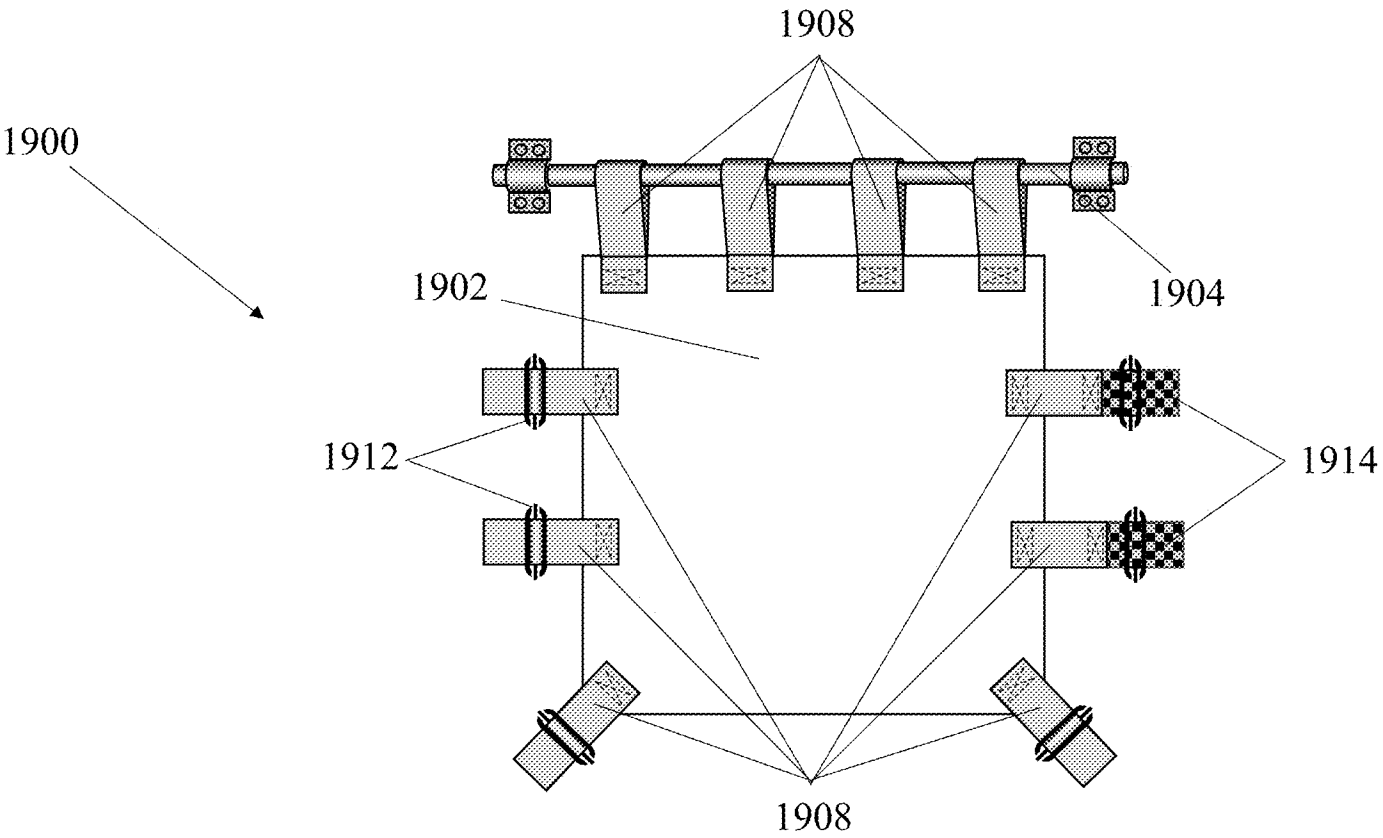
FIG. 19B is a perspective view of an embodiment similar to the embodiment of the anti-ballistic barrier system shown in FIG. 19A.
Figure 19C:
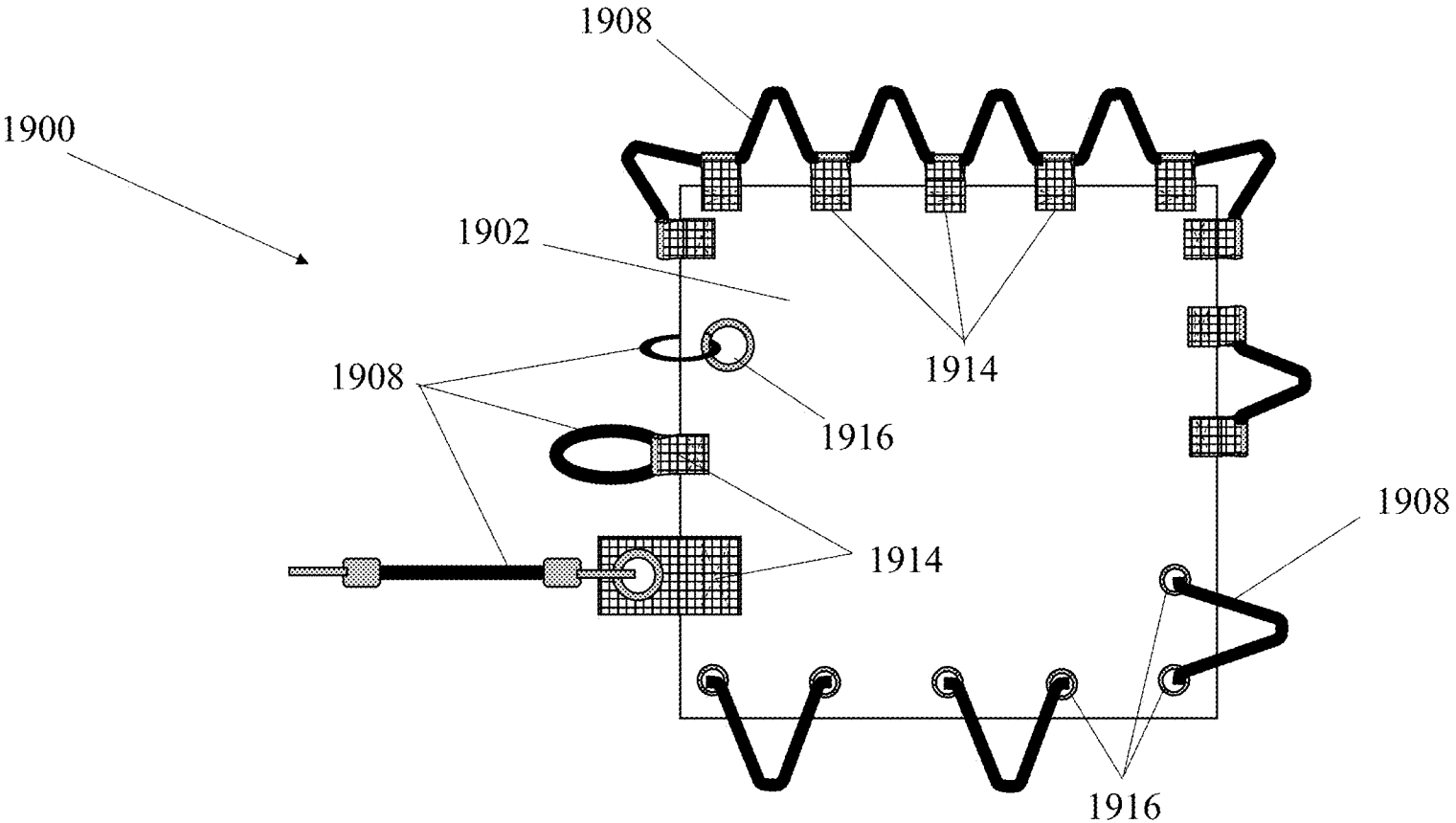
FIG. 19C is a perspective view of an anti-ballistic barrier system showing various methods of connecting the plurality of extendable connectors to the support structure surrounding the targeted area.

FIG. 19A illustrates an anti-ballistic barrier system 1900 with an anti-ballistic shield 1902, a top support mount 1904, a bottom support mount 1906, and one or more extendable connectors 1908. Similar to the anti-ballistic barrier system 100 disclosed above, the anti-ballistic shield 1902 may be formed of an anti-ballistic material and may be coupled to the top support mount 1904 and to the bottom support mount 1906 through at least one extendable connector 1908. The shield 1902 is configured to extend across a targeted area to protect against projectiles. Both the top support mount 1904 and the bottom support mount 1906 may be attached to the support structure. The extendable connector 1908 may be at least one extendable connector 1908, at least two extendable connectors 1908, or a plurality of extendable connectors 1908. The extendable connectors 1908 may extend along a side 1910 or a plurality of sides 1910 of the shield 1902 as shown in FIG. 19A. The extendable connectors 1908 may also extend around a perimeter of the shield 1902 as shown in FIGS. 19B and 19C. The extendable connectors 1908 may be spaced at regular intervals, or at irregular intervals. In some embodiments, the extendable connectors 1908 are formed as loops configured to loop around the support mounts 1904, 1906, as shown in FIGS. 19A and 19B. In some embodiments, the support mounts 1904, 1906 are elongated rods or bars, as shown in FIG. 19A. The support mounts 1904, 1906 may also be hooks attached to the support structure. The extendable connectors 1908 may be sewn to the shield 1902. As shown in FIG. 19B, the extendable connectors 1908 may be formed as strips of fabric configured to attach to the support structure through a buckle 1912 or other attachment mechanism. In such embodiments, the extendable connectors 1908 may be sewn to a dimensionally stable, or low stretch, fabric, which is then directly coupled to the buckle 1912, as this improves the ability of the buckle 1912 to securely restrain the extendable connectors 1908.

As shown in FIG. 19C, the extendable connectors 1908 may also be formed as an elastic roping, such as a bungee cord, rubber tubing, or other roped extendable material. In such embodiments, the extendable connectors 1908 may be coupled to the shield 1902 through a sewn tab 1914 or through an eyelet 1916. The eyelet 1916 may extend through the shield 1902, or may extend through a sewn tab 1914 attached to the shield 1902. The extendable connectors 1908 may be a longer length of roped extendable material that is threaded through multiple sewn tabs 1914, as shown in FIG. 19C. The extendable connectors 1908 may also be hooked through the eyelets 1916. Additionally, the extendable connectors 1908 may be threaded through a series of eyelets 1916. Multiple methods of coupling the extendable connectors 1908 to the shield 1902 may be implemented within the same embodiment, as shown in FIG. 19C.

Figure 20:
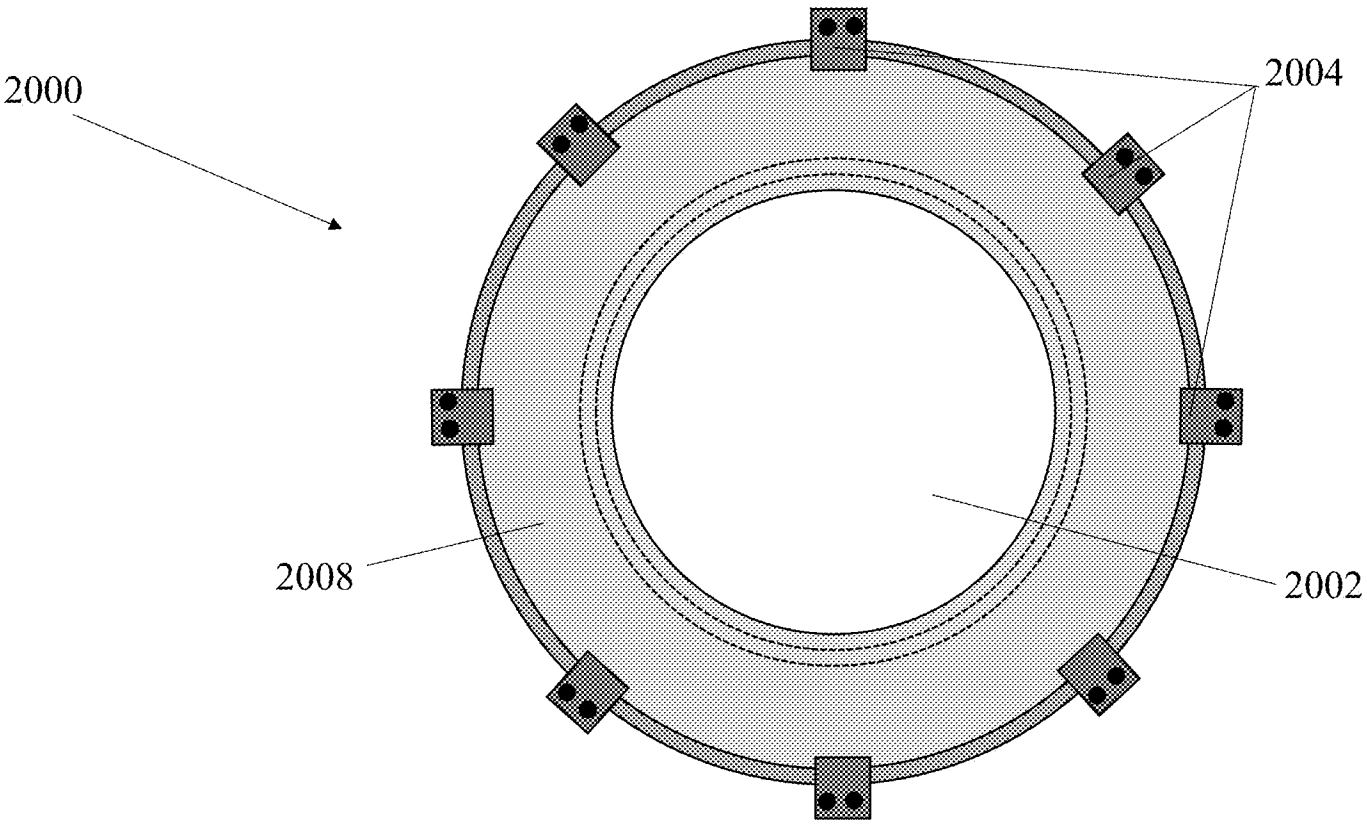
FIG. 20 is a front view of another embodiment of an anti-ballistic barrier system with a continuous extendable connector around the perimeter of the anti-ballistic shield.

FIG. 20 illustrates an anti-ballistic barrier system 2000 with an anti-ballistic shield 2002 and an extendable connector 2008. Similar to the anti-ballistic barrier system 100 disclosed above, the anti-ballistic shield 2002 may be formed of an anti-ballistic material and may be coupled to the support structure through at least one extendable connector 2008. The shield 2002 is configured to extend across a targeted area to protect against projectiles. The shield 2002 may have any shape. For example, although the shield 2002 is shown as being circular, the shield 2002 may also be triangular, rectangular, square, hexagonal, octagonal, or any other polygonal shape. The extendable connector 2008 may extend continuously around a perimeter of the shield 2002 and may be attached to the shield 2002 through stitching, rivets, grommets, or any other method of attaching fabric to another material. The extendable connector 2008 may be attached to the support structure through at least one support mount 2004 or a plurality of support mounts 2004. The support mount 2004 may be sewn tabs, buckles, clamps, loops, hooks, screws, or any other fastener known in the art.

Figure 21A:
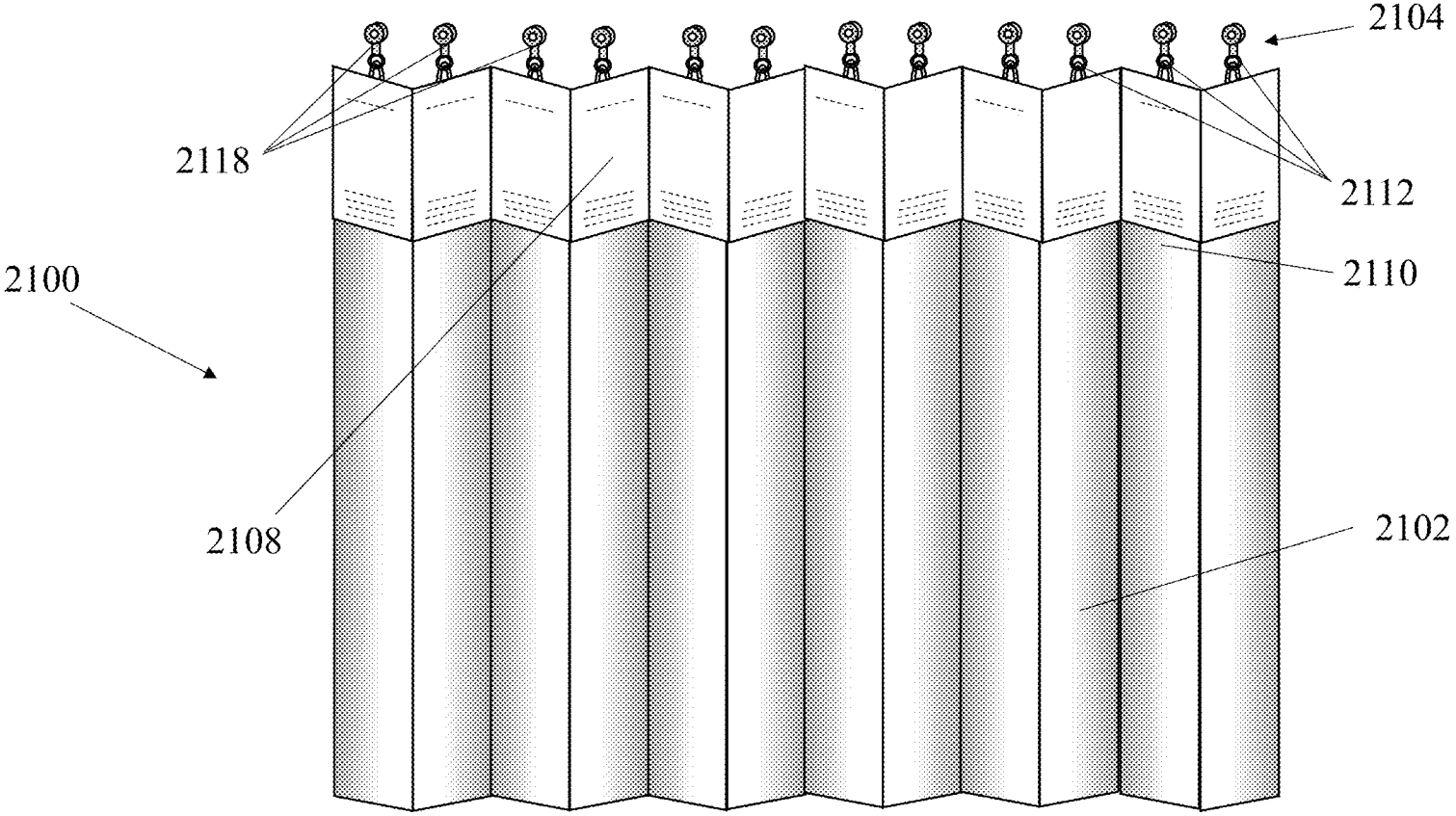
FIG. 21A is a perspective view of another embodiment of an anti-ballistic barrier system formed as a curtain with one extendable connector.
Figure 21C:
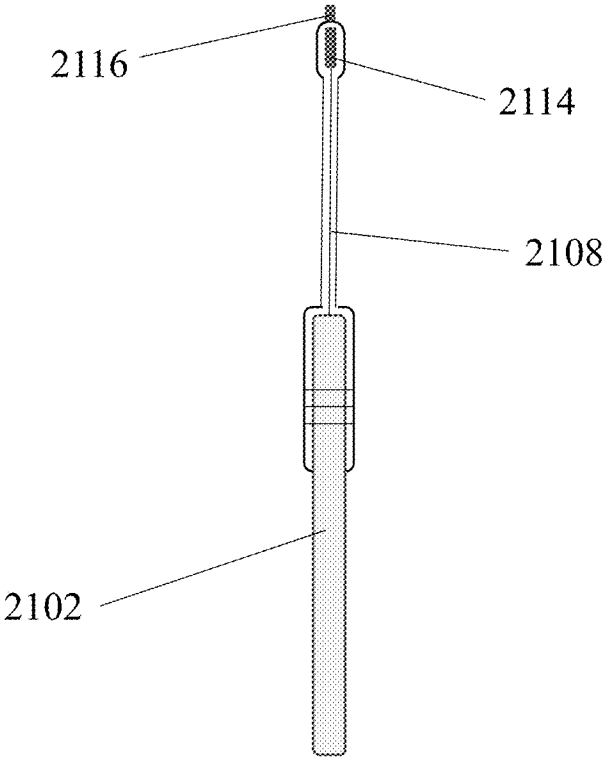
FIG. 21C is a cross section view of the extendable connector shown in FIG. 21B taken along line 21C-21C.
Figure 21B:
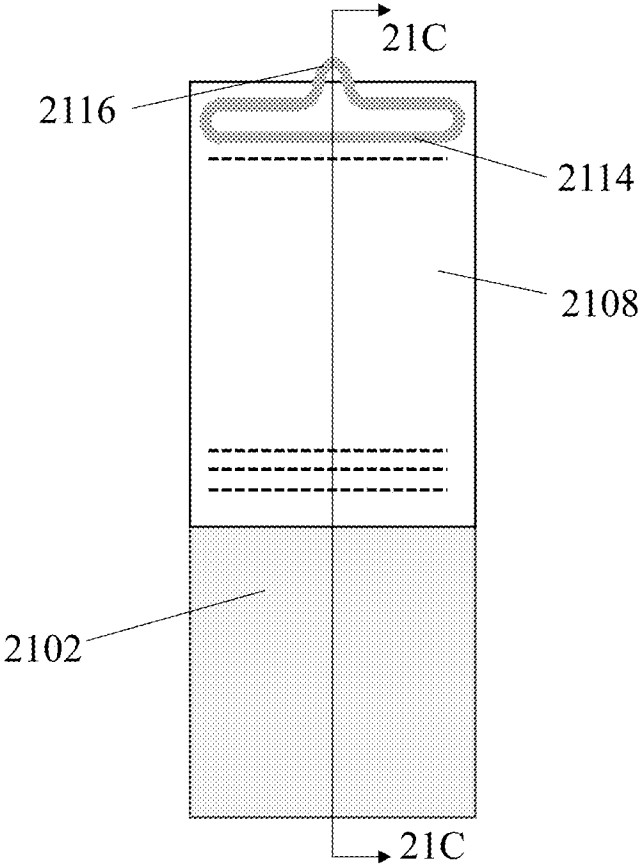
FIG. 21B is a close-up view of one of the extendable connectors of the anti-ballistic barrier system shown in FIG. 21A.
Figure 21D:
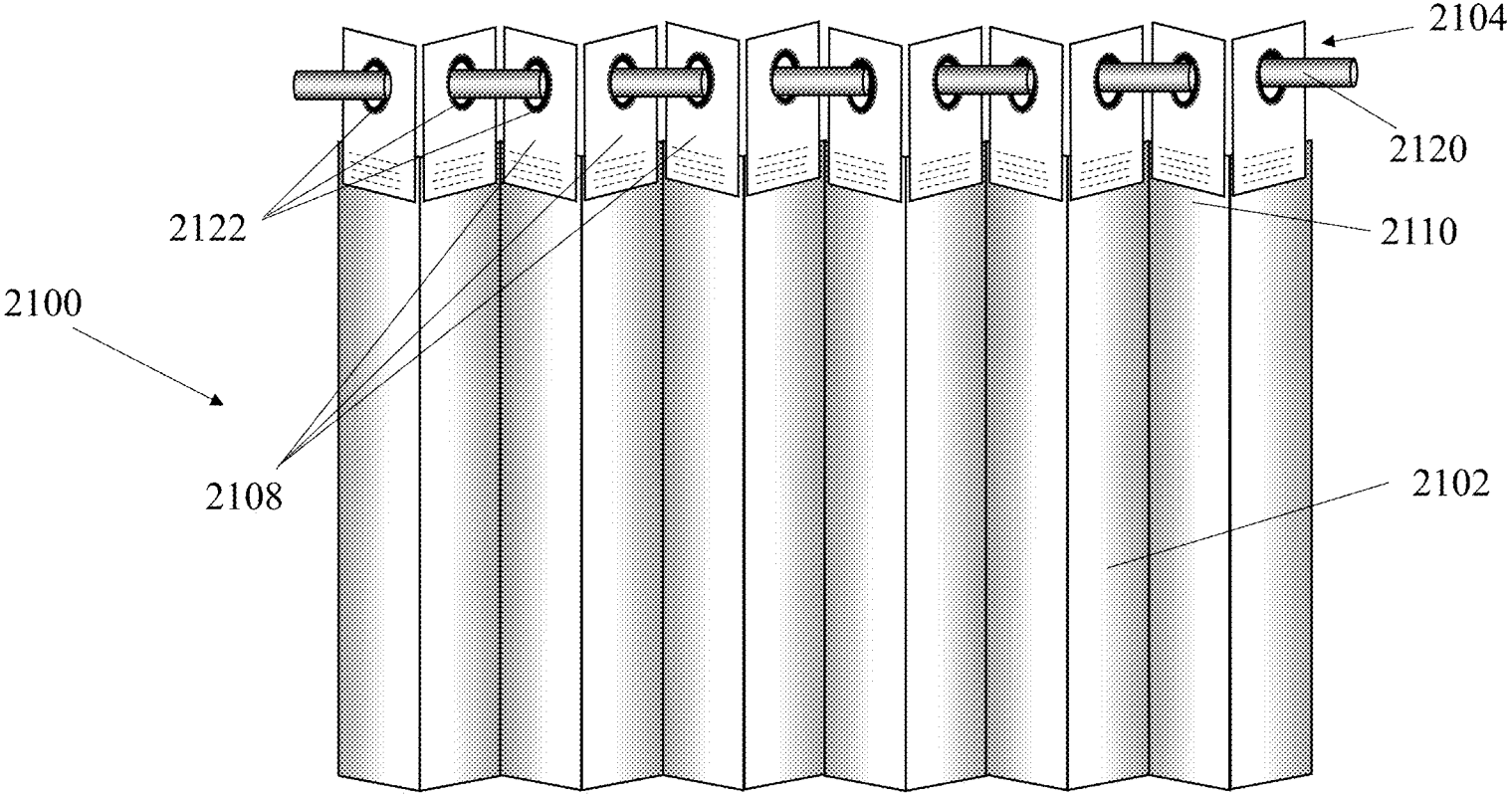
FIG. 21D is a perspective view of an embodiment similar to the embodiment of the anti-ballistic barrier system shown in FIG. 21A, but with a plurality of extendable connectors.

FIGS. 21A-21D illustrate an anti-ballistic barrier system 2100 with an anti-ballistic shield 2102, a support mount 2104, and an extendable connector 2108. Similar to the anti-ballistic barrier systems 100 discussed herein, the anti-ballistic shield 2102 may be formed of an anti-ballistic material and may be coupled to the support structure through at least one extendable connector 2108. The shield 2102 is configured to extend across a targeted area to protect against projectiles. The anti-ballistic barrier system 2100 may be formed as a pleated curtain. Both the anti-ballistic shield 2102 and the extendable connector 2108 may be pleated. The extendable connector 2108 may be continuous along the top edge 2110 of the shield 2102, as shown in FIG. 21A. Alternatively, the extendable connector 2108 may be a plurality of extendable connectors 2108, with each extendable connector 2108 attached to a different pleat of the shield 2102, as shown in FIG. 21D. The extendable connector 2108 and the shield 2102 may be sewn together. The support mount 2104 may be a plurality of track rollers 2112, as shown in FIGS. 21A-21C.

In use, the shield 2102 may be extended by drawing the curtain along the support bar in one direction to cover a majority of an area, or retracted by drawing the curtain back along the support bar in an opposite direction to suppose a majority of the area. Each track roller 2112 may comprise a hangar 2114 sewn into a pleat of the extendable connector 2018, as shown in FIG. 21B. The hangar 2114 may have a hook or loop 2116 configured to couple with a roller 2118 that is configured to engage with a track (not shown). The track may be coupled to the support structure. Thus, the plurality of track rollers 2112 is configured to support the anti-ballistic barrier system 2100 over the targeted area and allow the anti-ballistic barrier system 2100 to be laterally retracted to the side of the targeted area when not needed through compression of the pleats of the anti-ballistic barrier system 2100. The support mount 2104 may also be an elongated rod or a bar 2120, as shown in FIG. 21D. The extendable connector 2108 may comprise a plurality of holes, eyelets, or grommets 2122, allowing the elongated rod 2120 to extend through the grommets 2122 and thus support the anti-ballistic barrier system 2100 over the targeted area. Additionally, the elongated rod 2120 may allow the anti-ballistic barrier system 2100 to be laterally retracted to the side of the targeted area through compression of the pleats of the anti-ballistic barrier system 2100.

It will be understood that implementations of an anti-ballistic barrier are not limited to the specific assemblies, devices and components disclosed in this document, as virtually any assemblies, devices and components consistent with the intended operation of an anti-ballistic barrier may be used. Accordingly, for example, although particular anti-ballistic barriers, and other assemblies, devices and components are disclosed, such may include any shape, size, style, type, model, version, class, measurement, concentration, material, weight, quantity, and/or the like consistent with the intended operation of anti-ballistic barriers. Implementations are not limited to uses of any specific assemblies, devices and components; provided that the assemblies, devices and components selected are consistent with the intended operation of an anti-ballistic barrier.

Accordingly, the components defining any anti-ballistic barrier may be formed of any of many different types of materials or combinations thereof that can readily be formed into shaped objects provided that the materials selected are consistent with the intended operation of an anti-ballistic barrier. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, ultra high molecular weight (UHMW) polyethylene fiber or tapes, including Spectra®, Dyneema®, Tensylon®, and Endumax®, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various anti-ballistic barriers may be manufactured using conventional procedures as added to and improved upon through the procedures described here. Some components defining an anti-ballistic barrier may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling anti-ballistic barriers are not limited to the specific order of steps as disclosed in this document. Any steps or sequence of steps of the assembly of an anti-ballistic barrier indicated herein are given as examples of possible steps or sequence of steps and not as limitations, since various assembly processes and sequences of steps may be used to assemble anti-ballistic barriers.

The implementations of an anti-ballistic barrier described are by way of example or explanation and not by way of limitation. Rather, any description relating to the foregoing is for the exemplary purposes of this disclosure, and implementations may also be used with similar results for a variety of other applications employing an anti-ballistic barrier.

What is claimed is:

1. An anti-ballistic barrier system comprising:

an anti-ballistic shield formed of a flexible poly-aramid anti-ballistic material and configured to extend across a targeted area;

a polyester shield cover extending over a majority of each of a front side and a back side of the anti-ballistic shield, the polyester shield cover coupled to the anti-ballistic shield;

a plurality of support mounts configured to fixedly couple with a support structure adjacent to the targeted area, wherein the plurality of support mounts is configured to be positioned at regular intervals around a perimeter of the targeted area; and a plurality of extendable connectors fixedly attached to the anti-ballistic shield, wherein the plurality of extendable connectors are positioned at regular intervals around a perimeter of the anti-ballistic shield, the plurality of extendable connectors is configured to extend between the anti-ballistic shield and the plurality of support mounts and couple the anti-ballistic shield to the plurality of support mounts, and each of the plurality of extendable connectors is formed of a material having an elongation percentage property of at least 100%.

2. The anti-ballistic barrier system of claim 1, wherein the anti-ballistic shield is movable between an extended position in which the anti-ballistic shield extends across a majority of the targeted area and a retracted position in which a majority of the targeted area is exposed.

3. The anti-ballistic barrier system of claim 1, wherein the plurality of support mounts comprises a bar secured to the support structure and at least one of the plurality of extendable connectors is configured to loop around the bar.

4. An anti-ballistic barrier system comprising:

an anti-ballistic shield formed of a flexible poly-aramid anti-ballistic material and configured to extend across a targeted area;

at least one support mount configured to fixedly couple with a support structure adjacent to the targeted area; and at least two extendable connectors fixedly attached to the anti-ballistic shield, wherein the at least two extendable connectors are positioned along at least one side of the anti-ballistic shield, each of the at least two extendable connectors is configured to extend between the anti-ballistic shield and one of the at least one support mount and couple the anti-ballistic shield to the at least one support mount, and each of the at least two extendable connectors is formed of a material having an elongation percentage property of at least 50%.

5. The anti-ballistic barrier system of claim 4, further comprising a shield cover extending over a majority of each of a front side and a back side of the anti-ballistic shield, the shield cover coupled to the anti-ballistic shield.

6. The anti-ballistic barrier system of claim 4, wherein the at least one support mount is a plurality of support mounts.

7. The anti-ballistic barrier system of claim 6, wherein the plurality of support mounts is configured to be positioned at regular intervals along at least two sides of the targeted area.

8. The anti-ballistic barrier system of claim 4, wherein each of the at least two extendable connectors is formed of a material having an elongation percentage property of at least 100%.

9. The anti-ballistic barrier system of claim 4, wherein the anti-ballistic shield is movable between an extended position in which the anti-ballistic shield extends across a majority of the targeted area and a retracted position in which a majority of the targeted area is exposed.

10. The anti-ballistic barrier system of claim 4, wherein the at least one support mount comprises a bar secured to the support structure and at least one of the at least two extendable connectors is configured to loop around the bar.

11. An anti-ballistic barrier system comprising:

an anti-ballistic shield formed of a flexible poly-aramid anti-ballistic material and configured to extend across a targeted area;

at least one support mount configured to fixedly couple with a support structure adjacent to the targeted area; and at least one extendable connector attached to the anti-ballistic shield, wherein the at least one extendable connector is configured to extend between the anti-ballistic shield and the at least one support mount and couple the anti-ballistic shield to the at least one support mount, and wherein each of the at least one extendable connector is formed of a material having an elongation percentage property of at least 50%.

12. The anti-ballistic barrier system of claim 11, wherein the at least one extendable connector is fixedly attached to the anti-ballistic shield.

13. The anti-ballistic barrier system of claim 11, wherein the at least one extendable connector is a plurality of extendable connectors.

14. The anti-ballistic barrier system of claim 13, wherein the plurality of extendable connectors is positioned at regular intervals along at least two sides of the anti-ballistic shield.

15. The anti-ballistic barrier system of claim 11, further comprising a shield cover extending over a majority of each of a front side and a back side of the anti-ballistic shield, the shield cover coupled to the anti-ballistic shield.

16. The anti-ballistic barrier system of claim 11, wherein the at least one support mount is a plurality of support mounts.

17. The anti-ballistic barrier system of claim 16, wherein the plurality of support mounts is configured to be positioned at regular intervals along at least two sides of the targeted area.

18. The anti-ballistic barrier system of claim 11, wherein each of the plurality of extendable connectors is formed of a material having an elongation percentage property of at least 100%.

19. The anti-ballistic barrier system of claim 11, wherein the anti-ballistic shield is movable between an extended position in which the anti-ballistic shield extends across a majority of the targeted area and a retracted position in which a majority of the targeted area is exposed.

20. The anti-ballistic barrier system of claim 11, wherein the at least one support mount comprises a bar secured to the support structure and the at least one extendable connector is configured to loop around the bar.

* * * * *